US008413805B2

(12) United States Patent
Bray et al.

(10) Patent No.: US 8,413,805 B2
(45) Date of Patent: Apr. 9, 2013

(54) PACKAGES

(75) Inventors: Andrew Jonathan Bray, Southampton (GB); Alan Douglas Tearle, Southampton (GB)

(73) Assignee: British American Tobacco (Investments) Ltd., London (GB)

( * ) Notice: Subject to any disclaimer, the term of this patent is extended or adjusted under 35 U.S.C. 154(b) by 0 days.

(21) Appl. No.: 13/106,341

(22) Filed: May 12, 2011

(65) Prior Publication Data

US 2011/0226639 A1 Sep. 22, 2011

Related U.S. Application Data

(63) Continuation of application No. 11/795,742, filed on Jan. 9, 2009, now abandoned.

(30) Foreign Application Priority Data

Jan. 27, 2005 (GB) ..... 0501733.0

(51) Int. Cl.
*B65D 85/10* (2006.01)
*B65D 85/12* (2006.01)

(52) U.S. Cl.
USPC ..... 206/257; 206/264; 206/268

(58) Field of Classification Search ..... 206/257, 206/261, 268, 273, 264, 274; 493/84; D27/185–192
See application file for complete search history.

(56) References Cited

U.S. PATENT DOCUMENTS

| | | | | |
|---|---|---|---|---|
| 1,906,742 | A | 5/1933 | Coulapides | |
| 2,133,155 | A | 10/1938 | Stevens | |
| 2,310,711 | A | 2/1943 | Savage | |
| 2,320,006 | A | 5/1943 | Moore | |
| 2,809,467 | A | 10/1957 | St. Pierre et al. | |
| 2,959,338 | A | 11/1960 | Thurston | |
| 3,143,266 | A | 8/1964 | Imatake | |
| 3,226,010 | A | 12/1965 | Rogers, Jr. | |
| 3,530,614 | A | 9/1970 | Strongin | |
| 4,095,366 | A | 6/1978 | Buck et al. | |
| 4,657,248 | A | 4/1987 | Benaim | |
| 4,932,534 | A | 6/1990 | Focke et al. | |
| 5,261,533 | A * | 11/1993 | Adams et al. | 206/261 |
| 5,615,765 | A | 4/1997 | Roericht | |
| 5,628,670 | A | 5/1997 | Hill | |
| 5,701,696 | A | 12/1997 | Clontz | |
| 6,363,691 | B1 | 4/2002 | Flaherty | |

FOREIGN PATENT DOCUMENTS

| | | |
|---|---|---|
| JP | 05278757 | 10/1993 |
| JP | 2004209697 | 7/2004 |
| JP | 03086753 | 10/2005 |
| WO | 8886602 | 11/1988 |

* cited by examiner

*Primary Examiner* — J. Gregory Pickett
*Assistant Examiner* — Kaushikkumar Desai
(74) *Attorney, Agent, or Firm* — Middleton Reutlinger; Charles I. Sherman

(57) ABSTRACT

A package comprises first and second packs each capable of containing items. The packs are connected in a Jacob's ladder arrangement by straps which are initially joined together by a line of weakness, and which separate along the line of weakness upon first movement of the first and second packs relative to each other.

12 Claims, 33 Drawing Sheets

PACKAGES

CROSS-REFERENCE TO RELATED APPLICATION

This Continuation application under 35 USC §120 claims priority to, and benefit from, U.S. application Ser. No. 11/795,742 filed on Jan. 9, 2009, entitled Packages, which is currently pending and is a national stage filing (35.U.S.C 371) of PCT/GB2006/000245, filed on Jan. 25, 2006 which claims priority to and benefit from Great Britain Patent Application No. 0501733.0, filed on Jan. 27, 2005.

The present invention relates to packages. Illustrative embodiments of the invention relate to packages for smoking articles e.g. cigarettes or other elongate objects, but the invention is not limited to packages for elongate objects or packages for smoking articles It is known to connect two (or more) cigarette packets or to provide a package having two connected packs. See for example U.S. Pat. No. 1,906,742 and U.S. Pat. No. 5,344,008 both of which disclose a package comprising two packs connected together. When opened, the two packs can be fanned out.

Other examples are shown in U.S. Pat. Nos. 1,867,949, 1,850,410, 2,046,484, and International Design DM1018057. All of those examples have two (or more) packs hinged together.

U.S. Pat. No. 5,615,765 (Roericht) discloses a container comprising two half shells. The two half shells together form the body and lid of a closed container, for example a case for spectacles. The shells may be semi-circular or of other shape including triangular, rectangular or parallelogram-shaped. Each shell has first and second edges. First, second and third straps arranged side by side join the shells. The straps extend around the outsides of the shells. Assume the first and second straps are on the outside of the first shell and the third strap is on the outside of the second shell. The first and second straps each have first and second edges joined to the first edge of the first shell and the second edge of the second shell respectively. The third strap has a first edge joined to the second edge of the first shell and a second edge joined to the first edge of the second shell. The shells are linked by the straps, so that either one shell can roll over the outside of the other.

The present invention seeks to provide a novel package comprising two or more packs, each independently able to contain items, the packs being connected in an interesting way.

According to one aspect of the present invention, there is provided a package comprising: first and second packs each capable of containing items, each pack having a first face bound by a first edge and a second edge, the second edge being parallel to the first edge; and means, connecting the first and second packs, which means comprising first and second straps which are attachable to the first and second packs; wherein, in a first position of the packs the first face of the first and second packs face each other with the first edges of the first and second pack adjacent to each other and the second edges of the first and second pack adjacent each other, the first and second straps extending across the first face and being hinged about the first and second edges, wherein the first strap is hinged about the first edge of the first pack and hinged about the second edge of the second pack and the second strap is hinged about the second edge of the first pack and hinged about the first edge of the second pack, whereby the first and second packs are movable, one relative to the other between at least the first position, a second position in which the second pack is rotated relative to the first pack about the first edge and a third position in which the second pack is rotated relative to the first pack about the second edge.

The said first face and the first and second edges upstand from the base.

The packs may be rigid or may be soft cup packs.

In an embodiment of the invention, each pack has a rectangular base, and is made up of first and second major faces and first and second side faces. The first edge of each pack is at the intersection of the first major face with the first side face and the second edge is at the intersection of the first major face with the second side face.

The straps may be of any suitable flexible material. The straps are elongate and of any suitable width and length. Any number of straps greater than or equal to two may be used. In the examples described herein three straps are used.

Thus the two packs are connected in a Jacobs Ladder arrangement. This provides an interesting arrangement of packs. The straps each have two faces which can be seen in different positions of the two packs. The faces of a strap may have indicia and/or graphics thereon. At least one strap may have indicia and/or graphics on both faces.

The packs may initially be empty or may contain items.

Another aspect of the invention provides a blank comprising a single sheet of material, having at least a first region providing a first strap and a second region providing a second strap, the regions being adjoined by a line operable to separate the first region from the second region, the line having a first, second and third section thereon, the second section being a weakened section such that the first and second regions are separable, and the first and second sections being cut portions extending from respective ends of the weakened section to the edge of the sheet.

The sheet may be rectangular having major and minor edges, the said line and regions being parallel to the major edges of the sheet and the first cut extends from a minor edge and the second cut extends to another minor edge. Alternatively, the sheet may be arranged where the line and the regions are parallel to the minor edges of the sheet. The blank may be of plastic, paper or card. The plastic may be cellophane, polypropylene or other suitable plastic.

A further aspect of the invention comprises a blank comprising a single sheet of material having a first elongate section in which there is an elongate hole having major edges which are spaced apart and a second section aligned with the hole and extending from a minor edge of the first section, the second section having a maximum width substantially equal or less than the minimum width of the hole and a length greater than the length of the hole such that a free minor edge of the second section is threadable through the hole and capable of attaching to the free minor edge of the first section.

Yet another aspect of the invention comprises a package comprising two packs joined together in a Jacobs Ladder arrangement. In an example, each packet is individually wrapped in plastics wrapping. In another example, the two packs share one hinged lid.

Another aspect of the invention provides a method of making a package comprising:

providing a first pack and a second pack;

placing at least first and second straps between the first and second packs; and fixing the straps to the packs to join the packs in a Jacobs Ladder arrangement.

In an embodiment of the method, the first and second straps are placed on the first pack and the second pack is then placed on the first and second straps.

The fixing step may comprise fixing at least one of the straps to the first pack before the second pack is placed thereon.

The straps may be integral parts of a unitary blank. Alternatively, the straps may be separate ab initio.

The method may further comprise providing a hinged lid which closes both of the packs. For a better understanding of the present invention, and to show how the same may be carried into effect, reference will now be made by way of example to the accompanying drawings in which:

FIGS. 1A, B and C are top (or bottom) plan views of examples of first to fourth packages according to the invention:

Figures 4A, 4B:
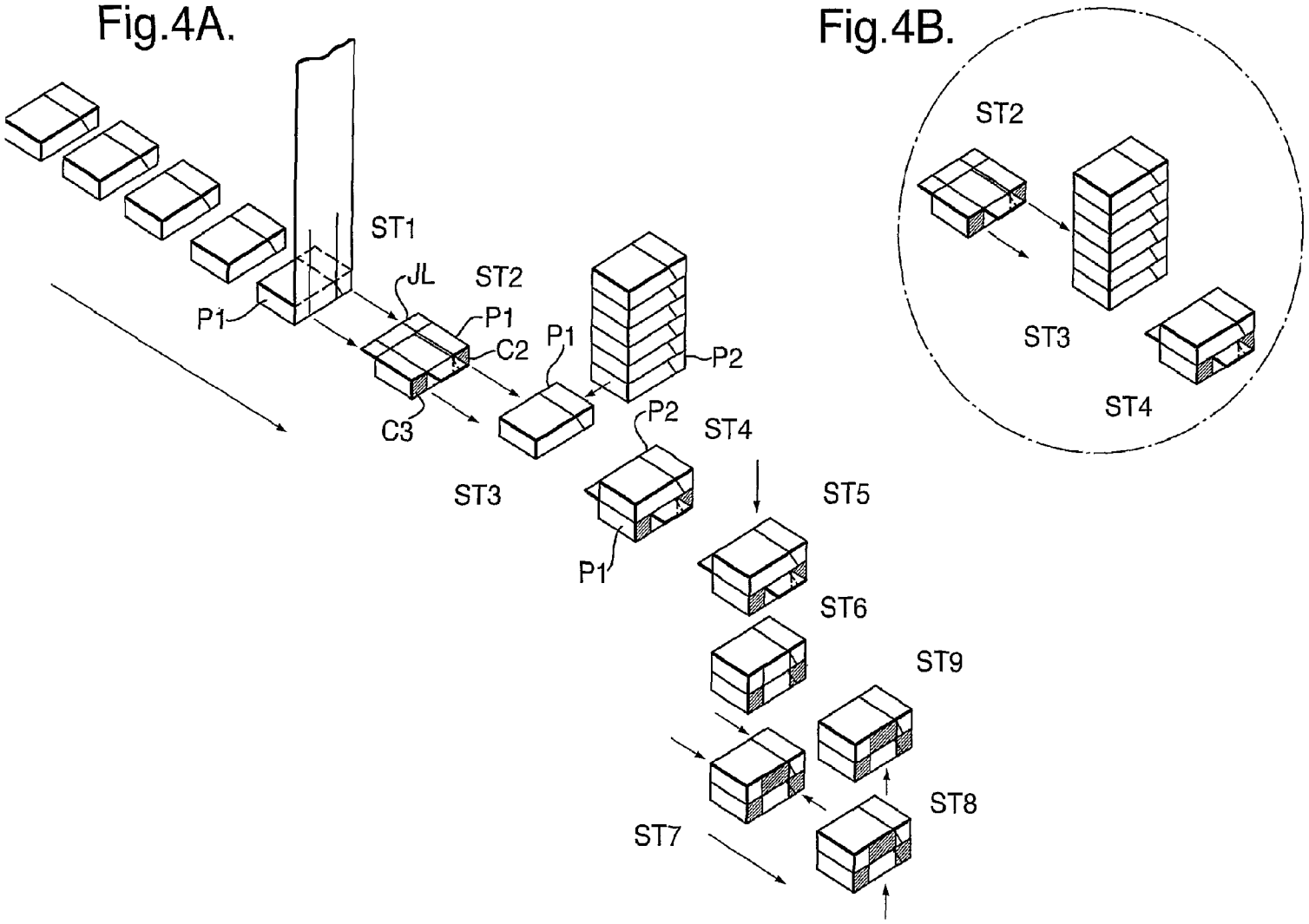
Figure 5:
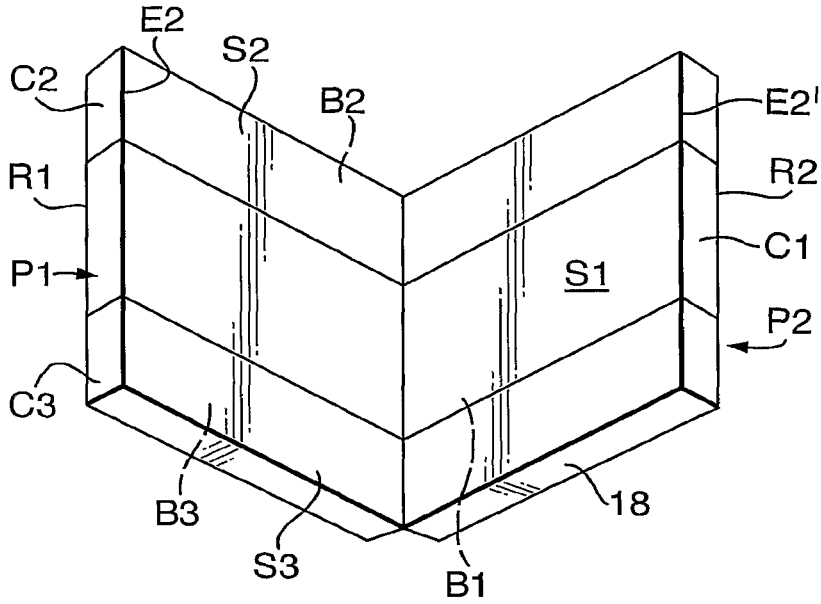
Figure 7:
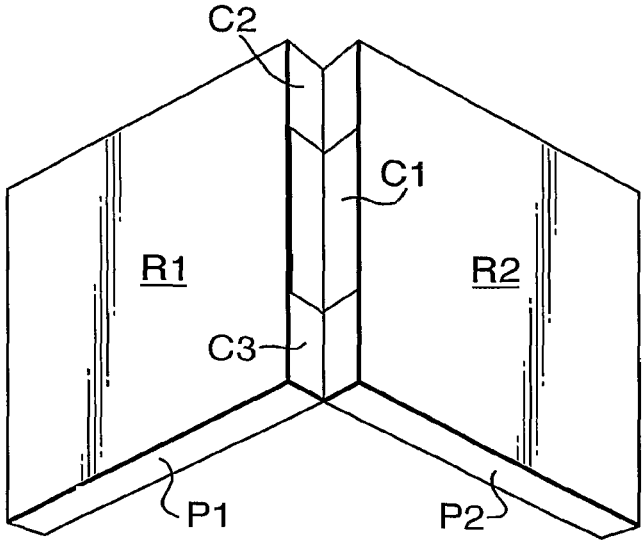
Figure 6A:
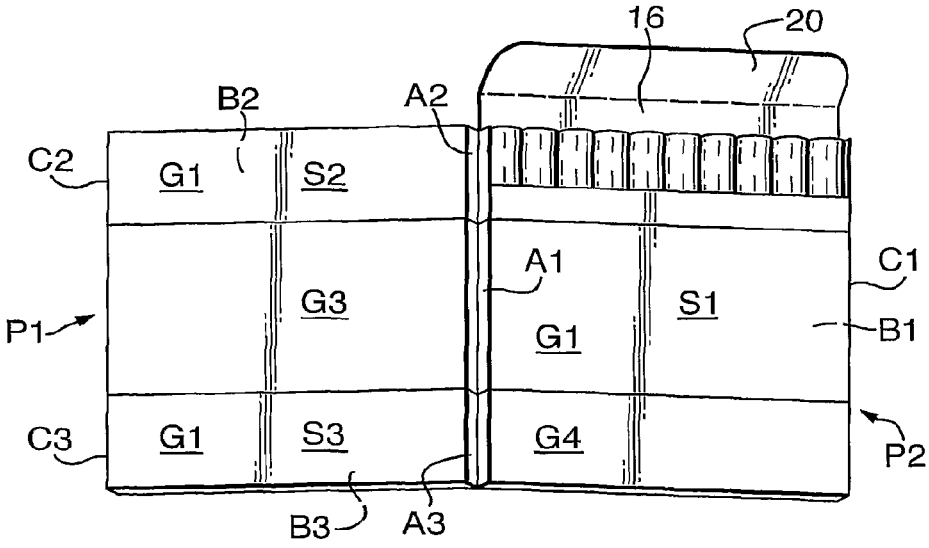
Figure 6B:
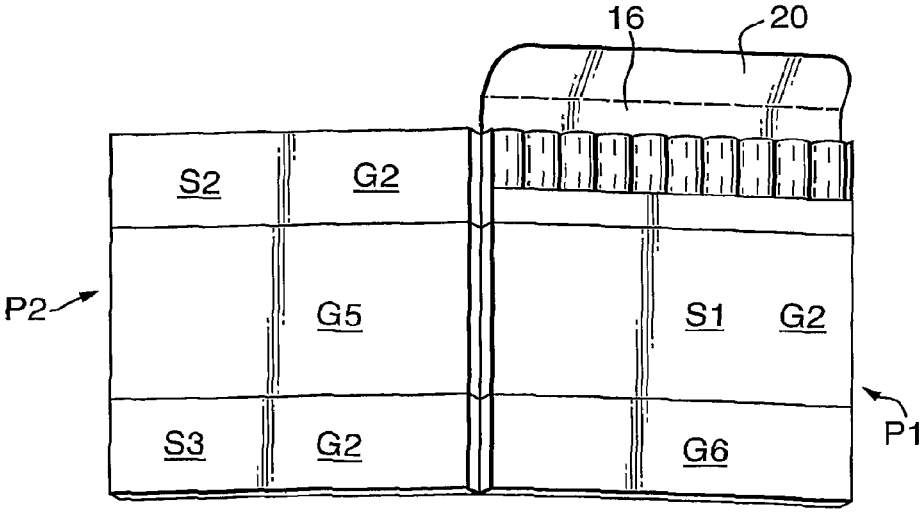
Figure 8A:
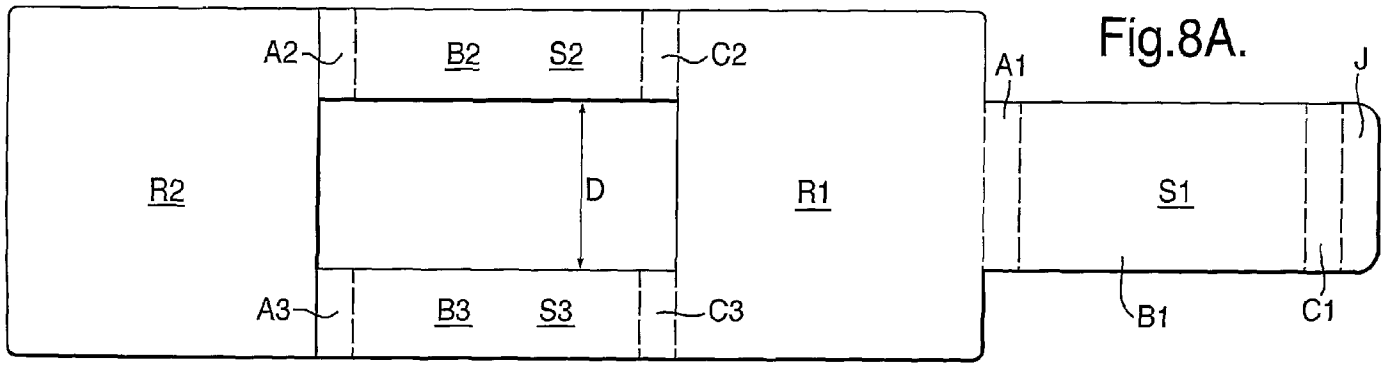
Figure 8B:
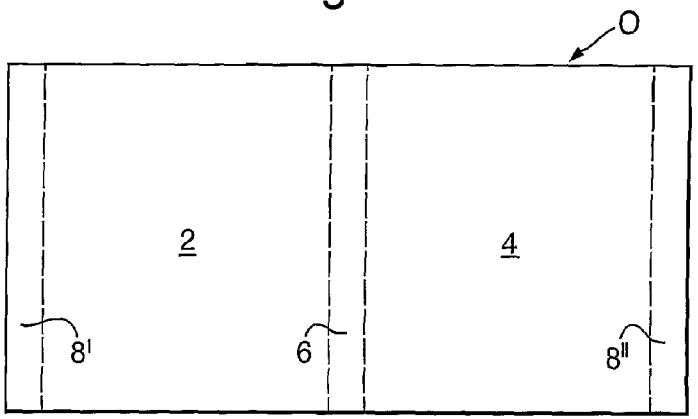
Figure 8C:
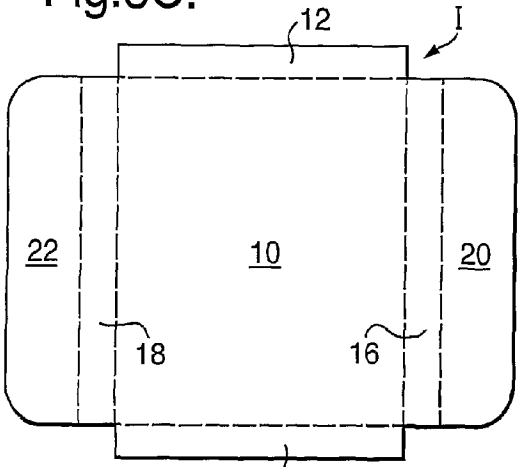
Figure 9A:
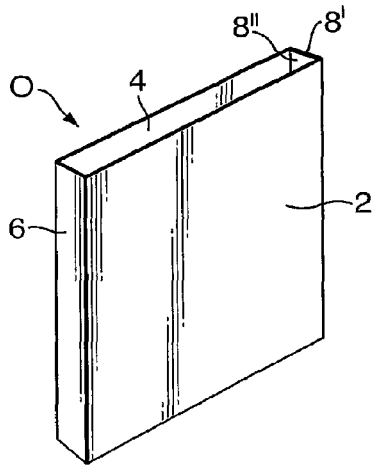
Figure 9B:
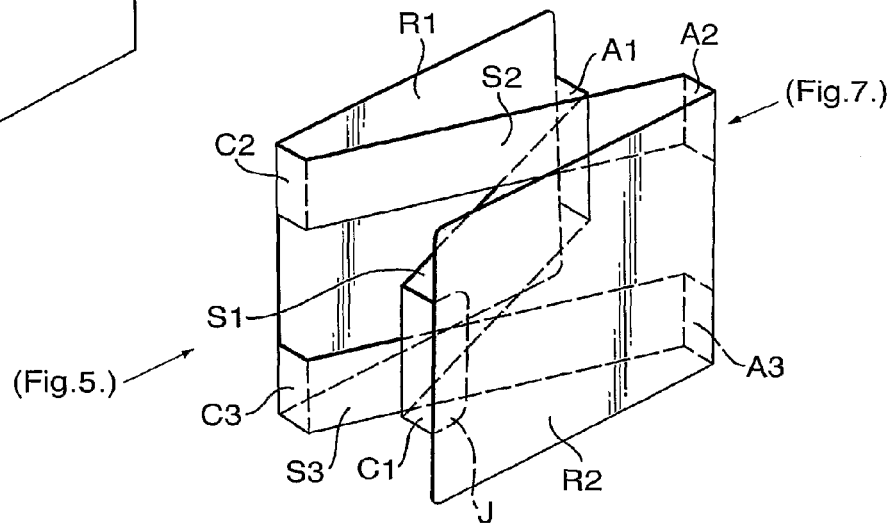
Figure 9C:
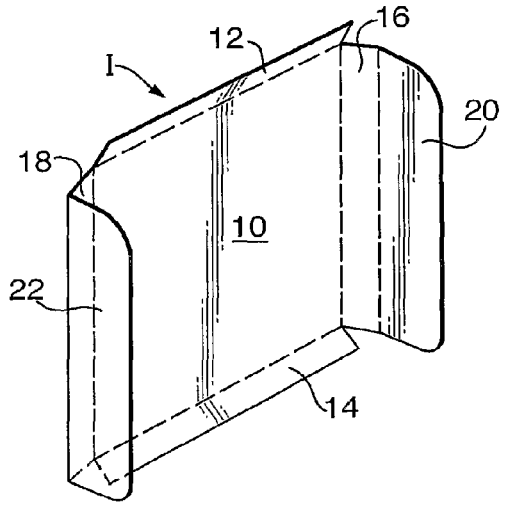
Figure 10:
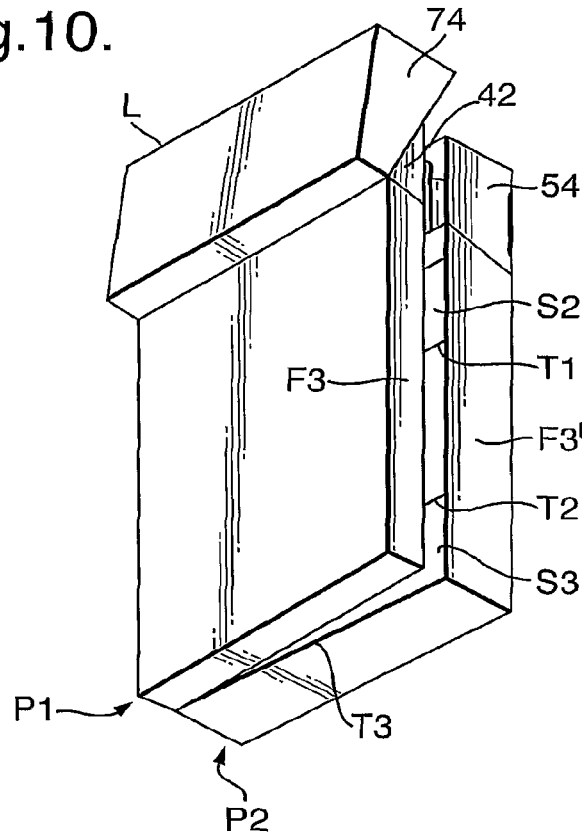
Figure 11:
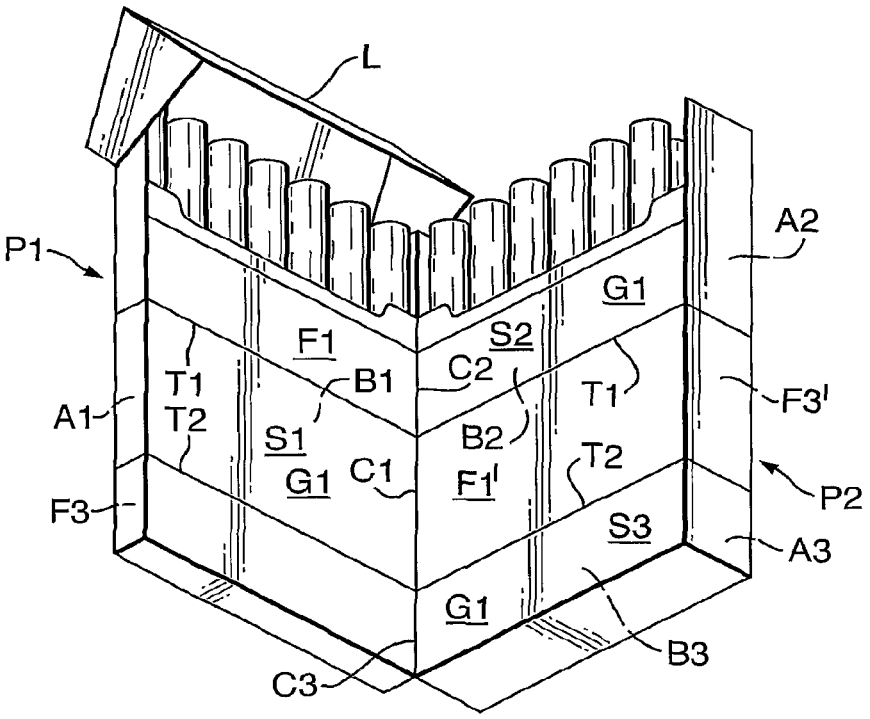
Figure 12:
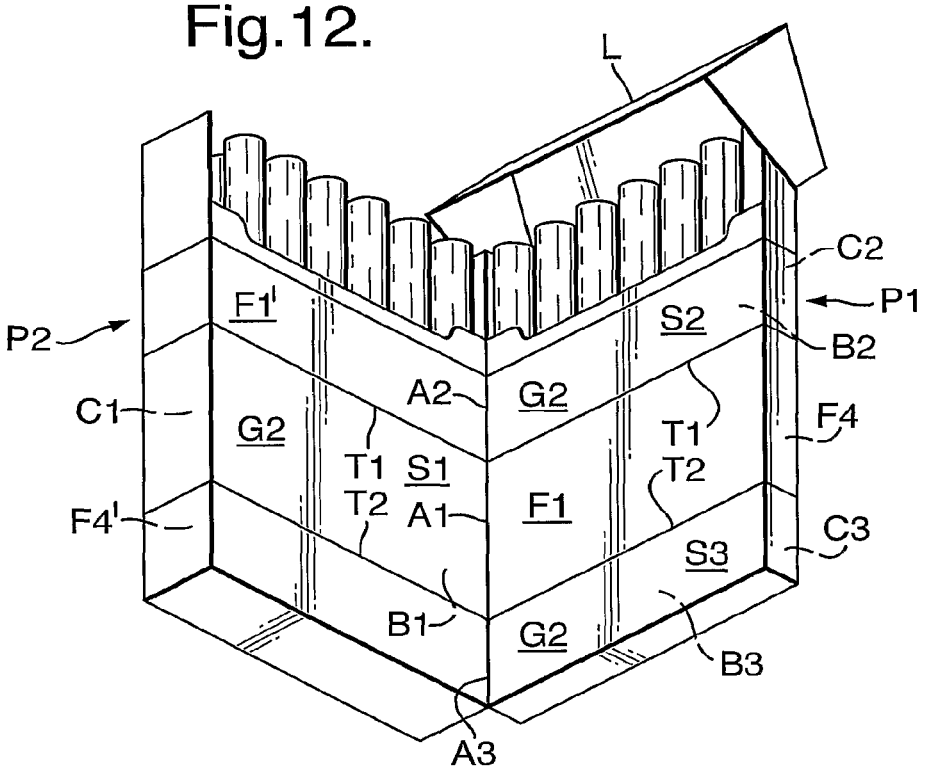
Figure 13:
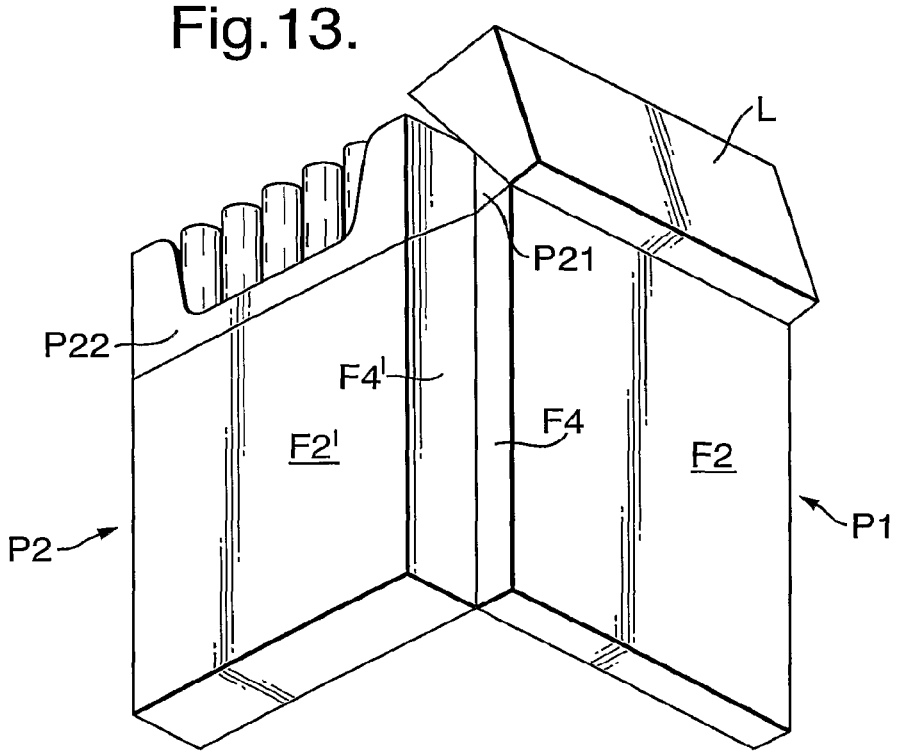
Figure 14:
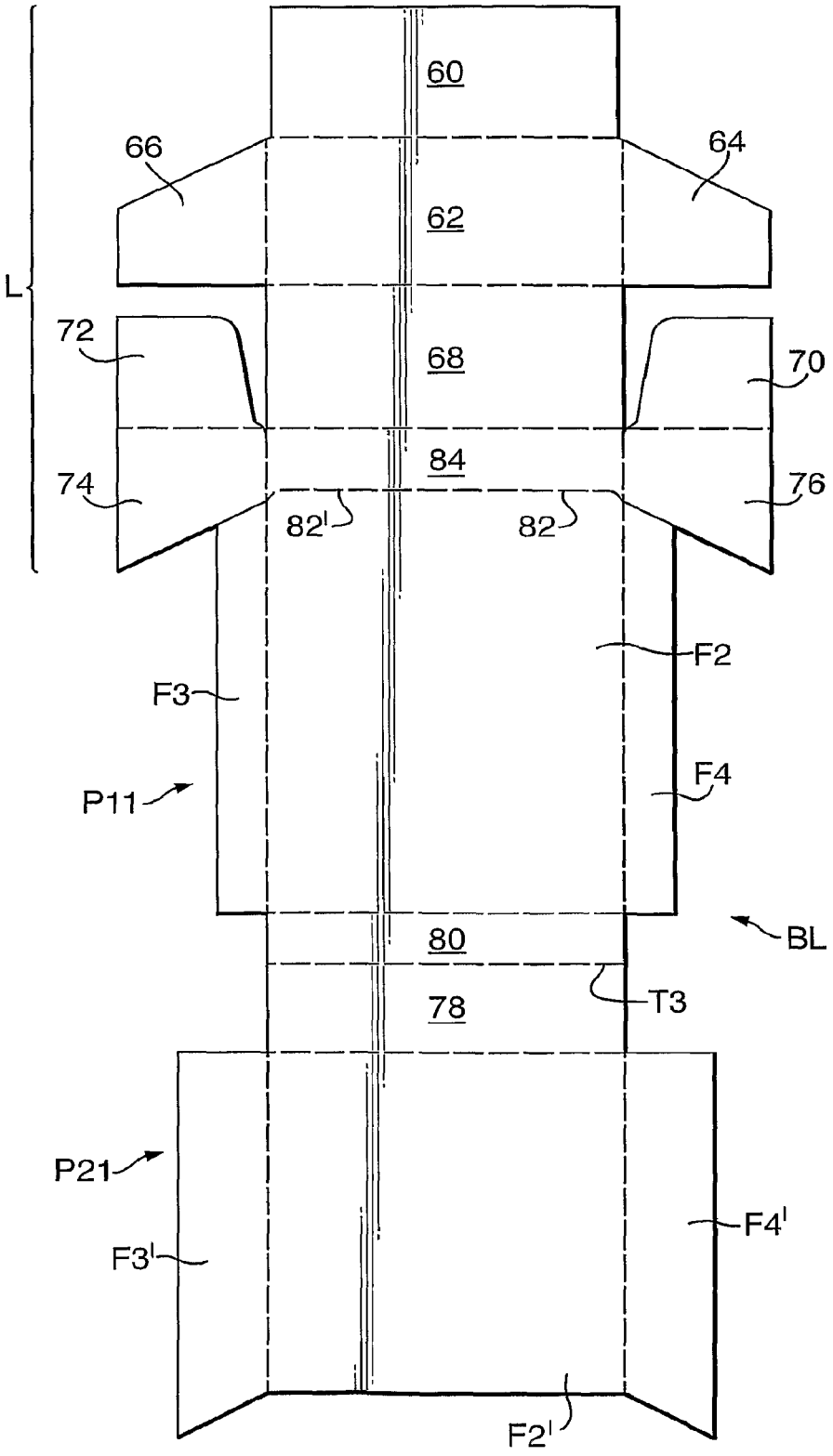
Figure 15A:
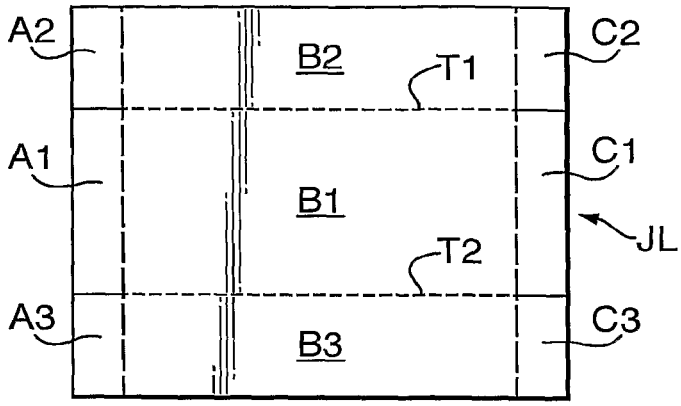
Figure 15B:
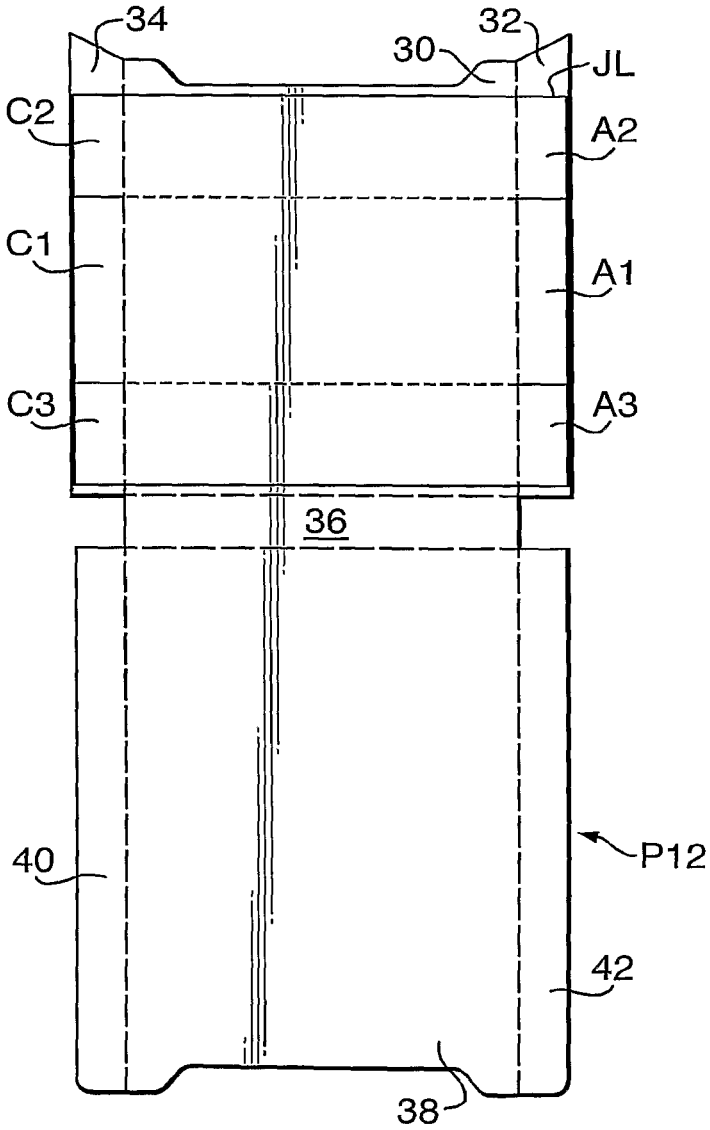
Figure 15C:
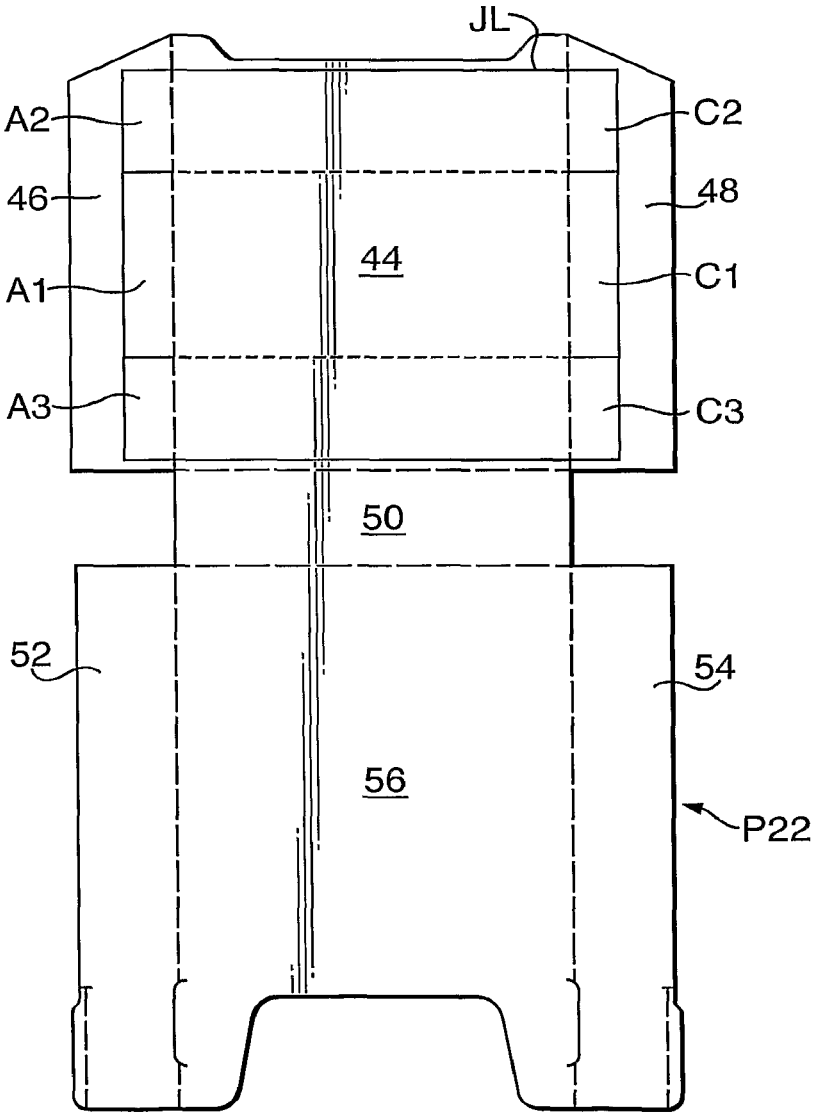
Figure 17:
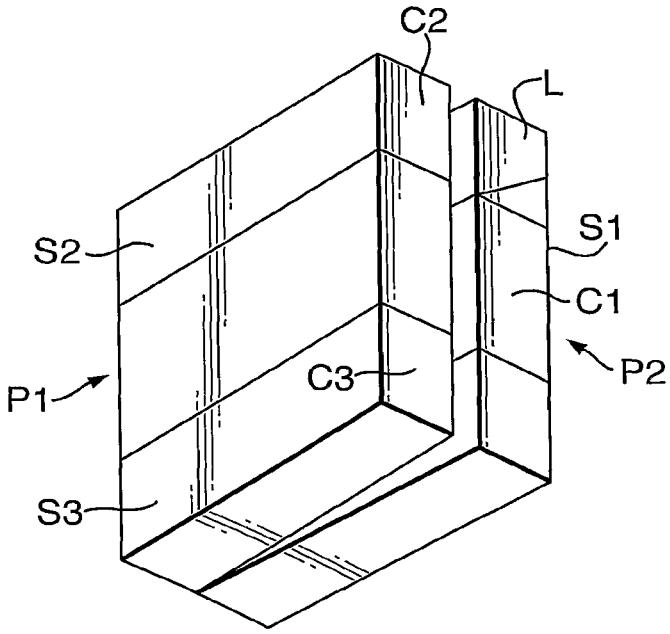
Figure 18:
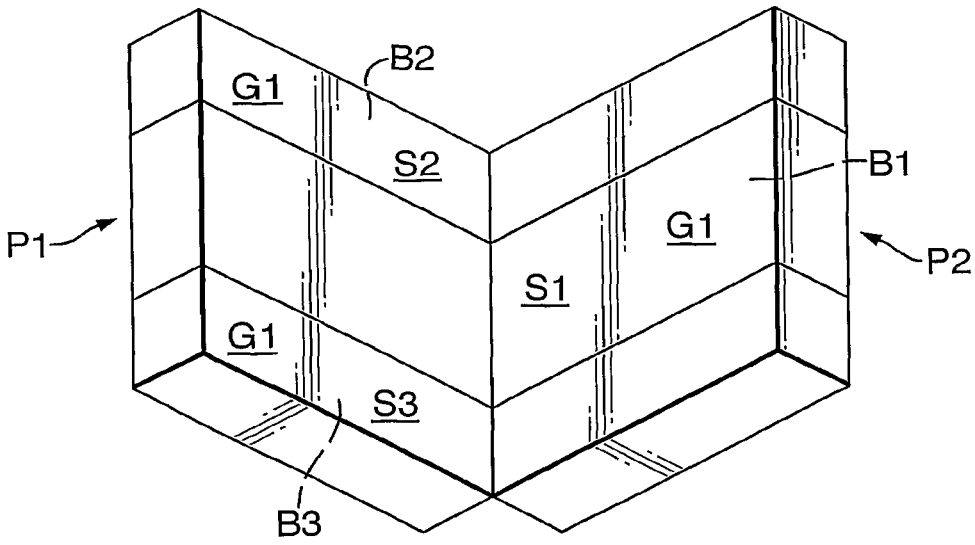
Figure 19:
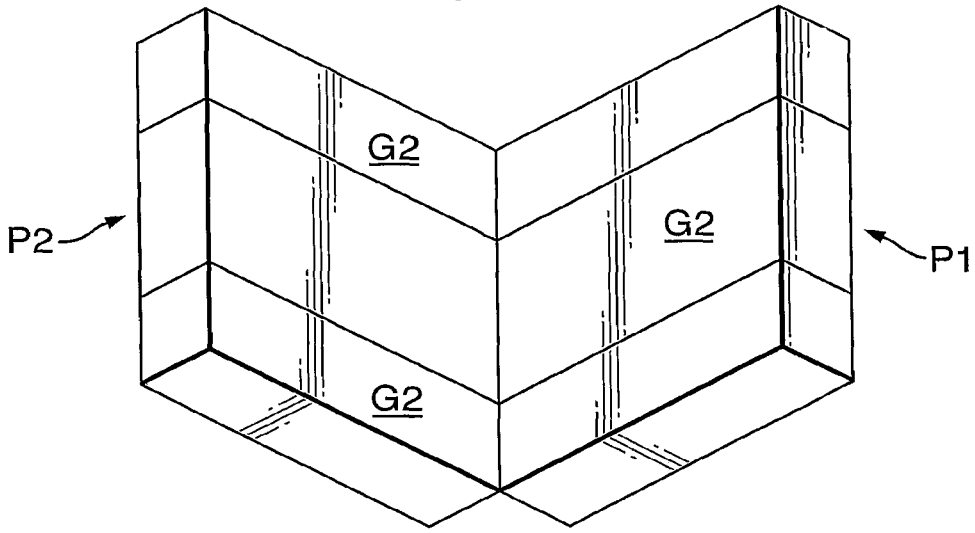
Figure 20:
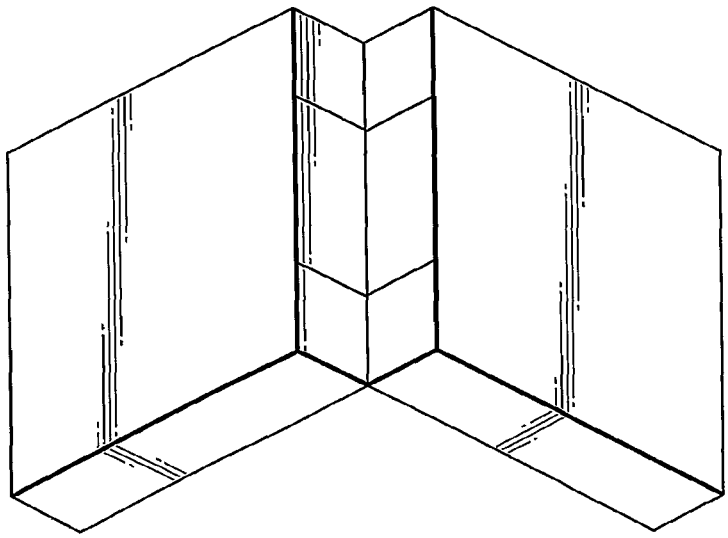
Figure 21:
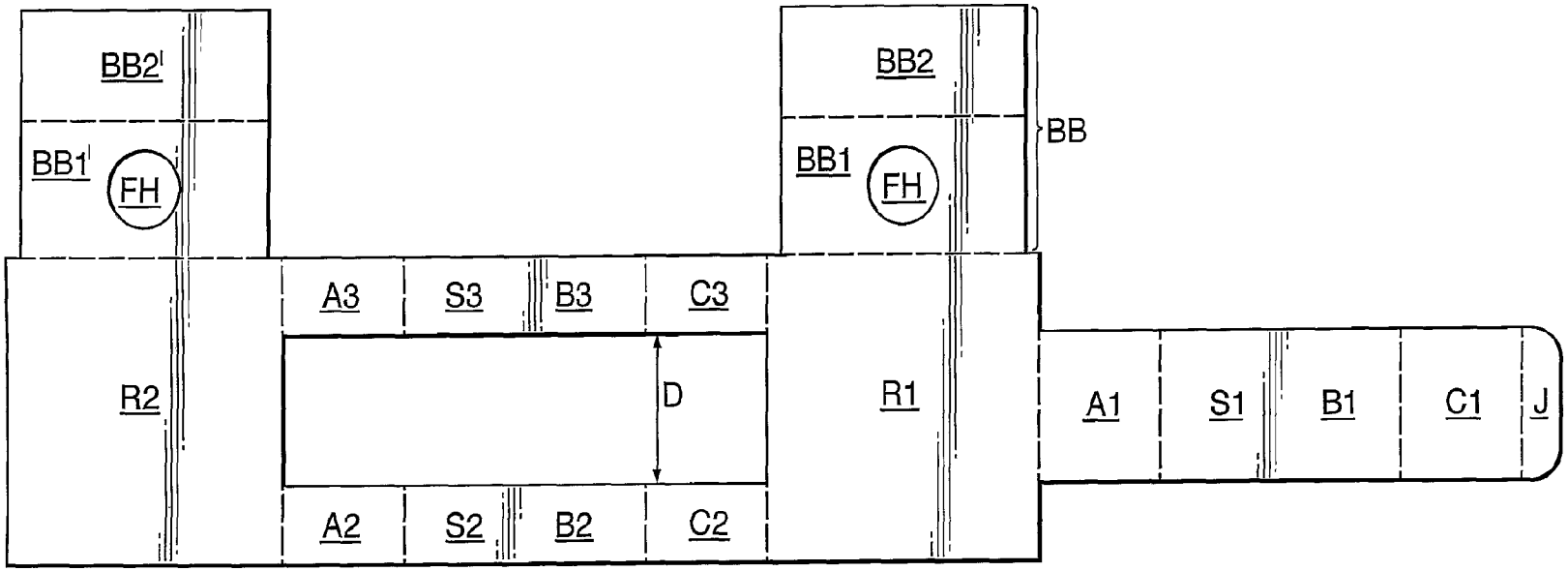
Figure 22:
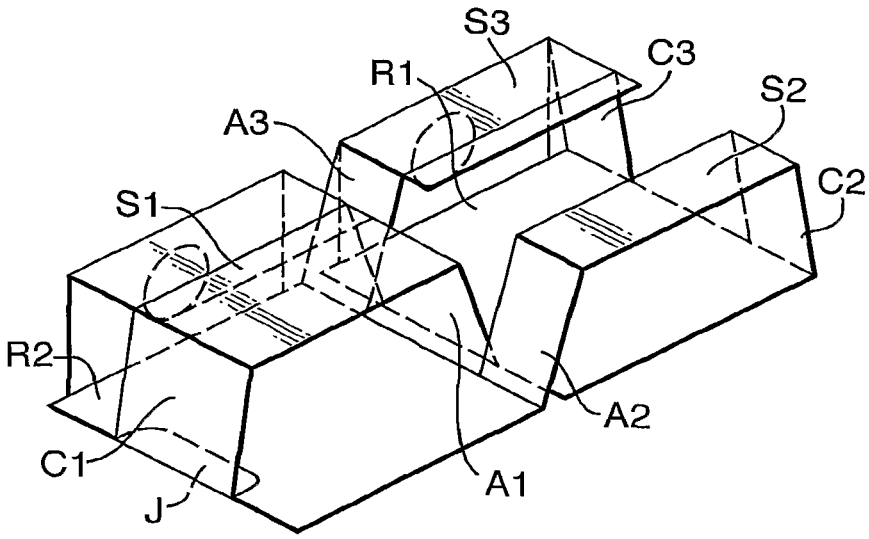
Figure 25A:
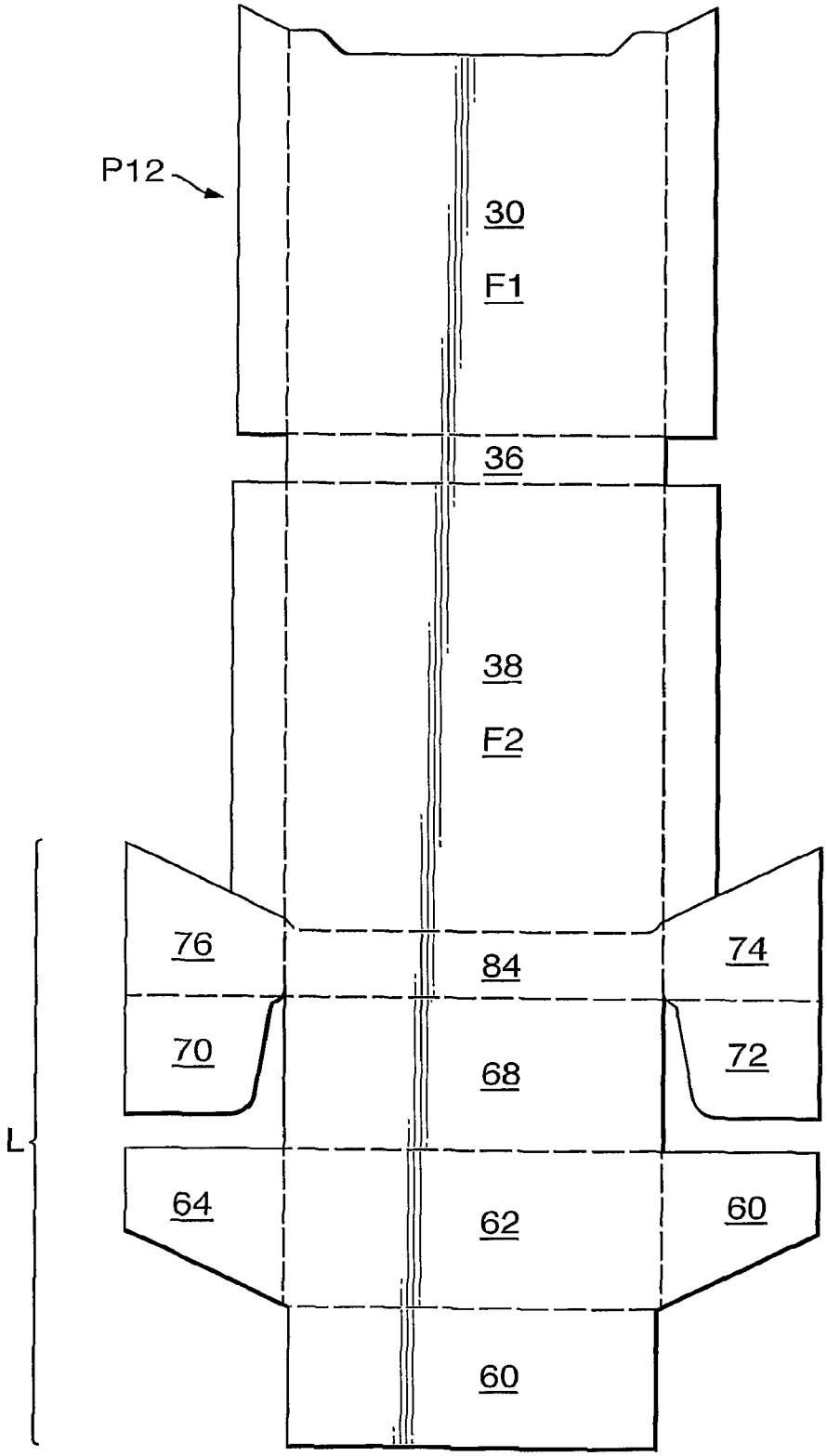
Figure 25B:
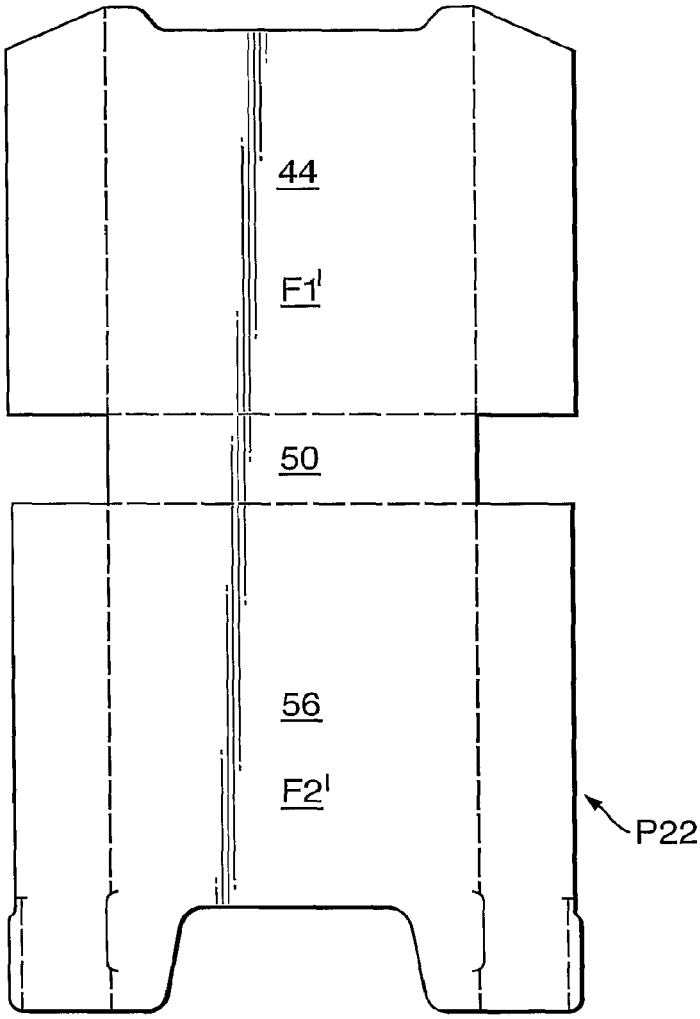
Figure 25C:
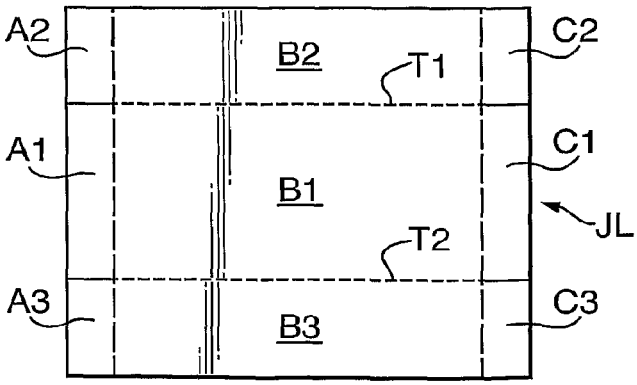
Figure 26A:
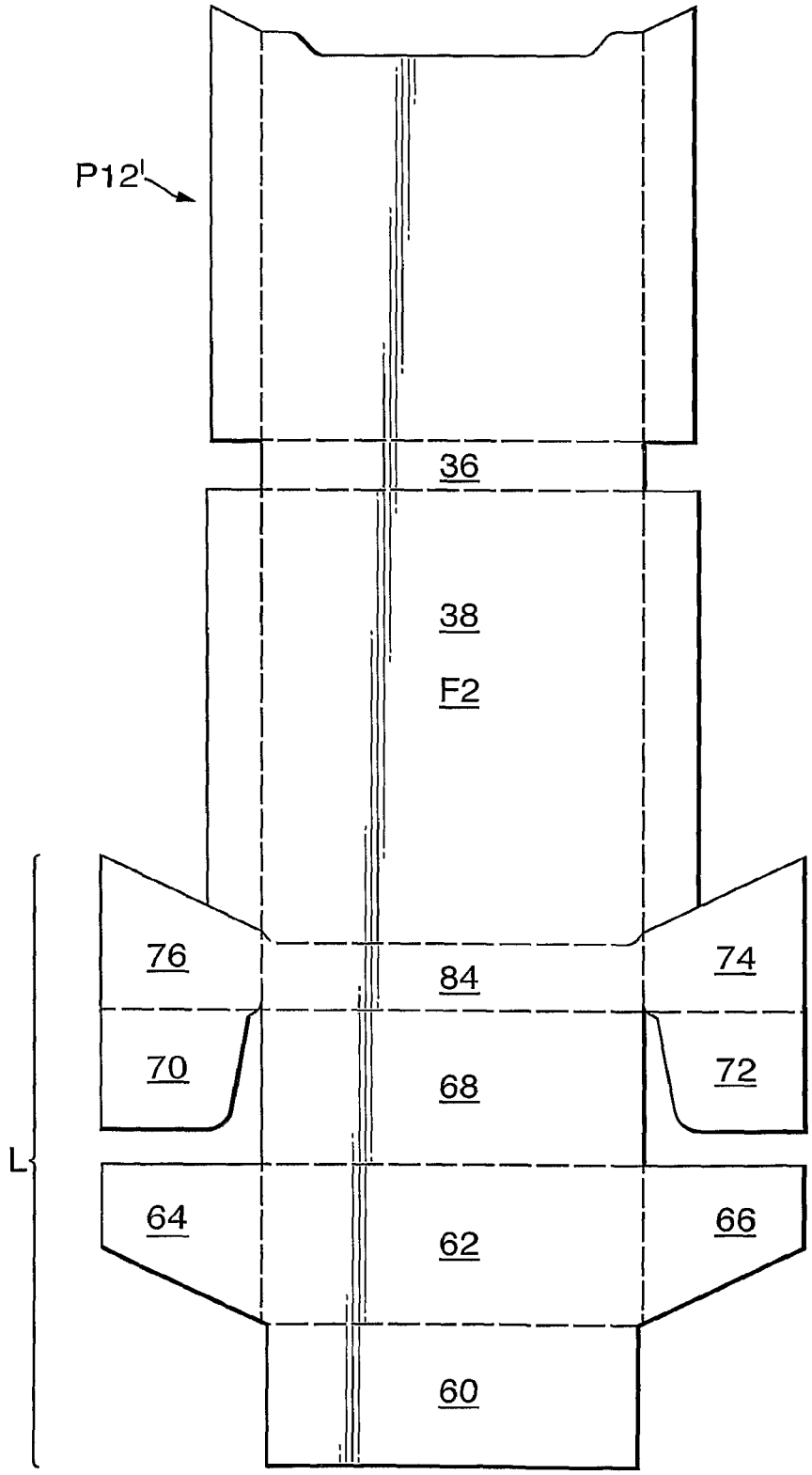
Figure 26C:
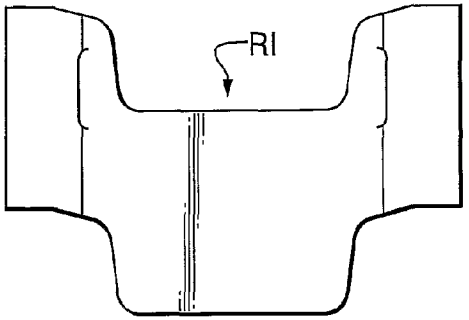
Figure 26D:
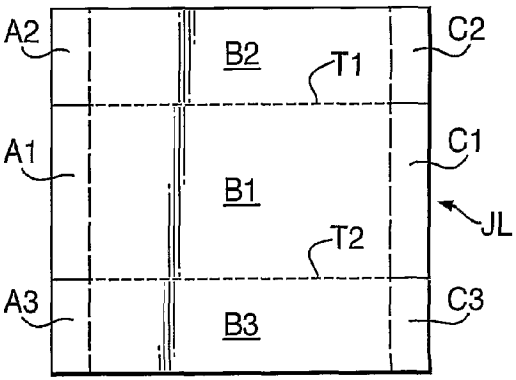
Figure 26B:
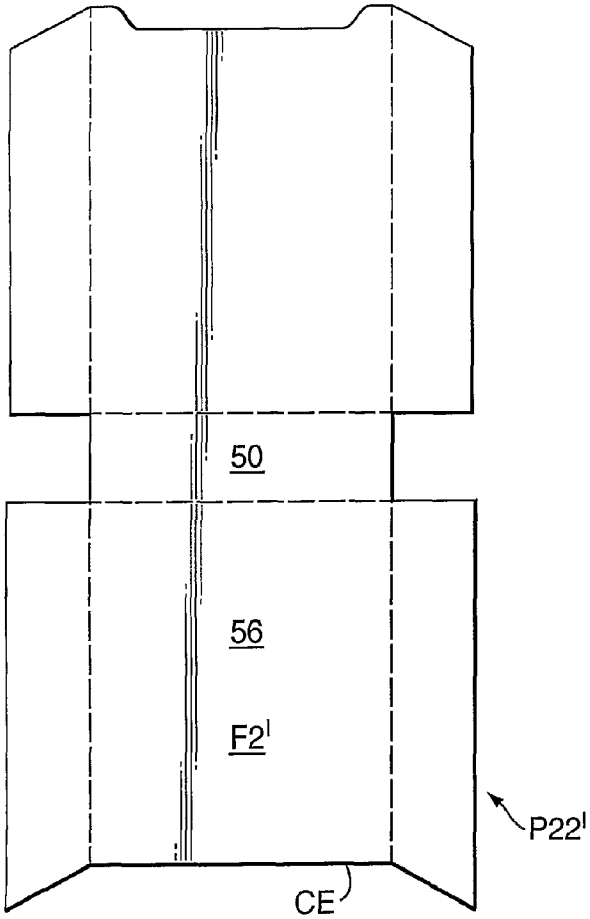

FIGS. 4A and B illustrate one method of making a package in accordance with the present invention;

FIG. 5 is a perspective view of a fifth, partially open, package according to the invention;

FIG. 6A is a plan view of the fifth package open in one configuration;

FIG. 6B is a plan view of the fifth package open in another configuration;

FIG. 7 is a rear view of the fifth package partially open;

FIGS. 8A to C are plan views of blanks useful in the fifth package of FIGS. 5 to 7;

FIGS. 9A to C are views of the blanks of FIG. 8 folded as in use in the fifth package;

FIG. 10 is a perspective view of a partially open sixth package;

FIG. 11 is a plan view of the sixth package open in one configuration;

FIG. 12 is a plan view of the sixth package open in another configuration;

FIG. 13 is a rear view of the sixth package partially open;

FIG. 14 is a plan view of a blank useful in the sixth package;

FIGS. 15A to C are plan views of other blanks useful in the sixth package;

FIGS. 16A to D are views of the blanks of FIGS. 14 and 15 partially folded for use in the sixth package;

FIG. 17 is a perspective view of a seventh package;

FIG. 18 is a plan view of the seventh package open in one configuration;

FIG. 19 is a plan view of the seventh package open in another configuration;

FIG. 20 is a rear view of the seventh package partially open;

FIG. 21 is a plan view of a blank useful in the seventh package;

FIG. 22 is a view of the blank of FIG. 21 folded as in use in the seventh package;

FIGS. 23A to 23D illustrate the blanks used to form a first variant of an eighth package;

FIGS. 24A to 24E illustrate the blanks used to form a second variant of an eighth package;

FIGS. 25A to 25C illustrate the blanks used to form a third variant of a eighth package;

FIGS. 26A to 26D illustrate the blanks used to form a fourth variant of an eighth package.

Figure 27:
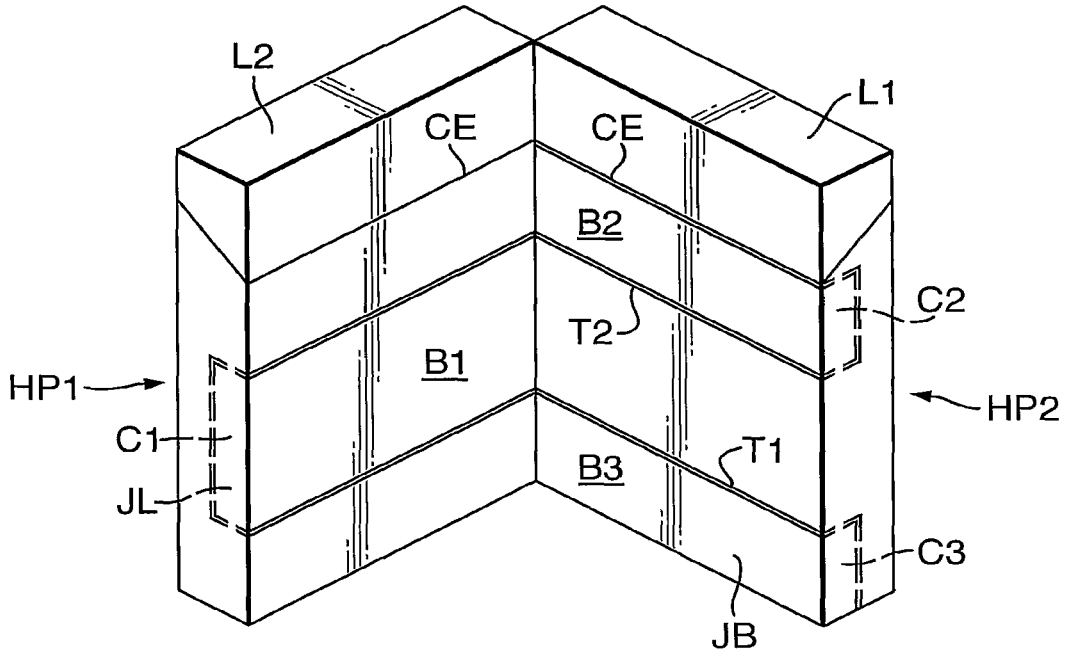
Figure 28C:
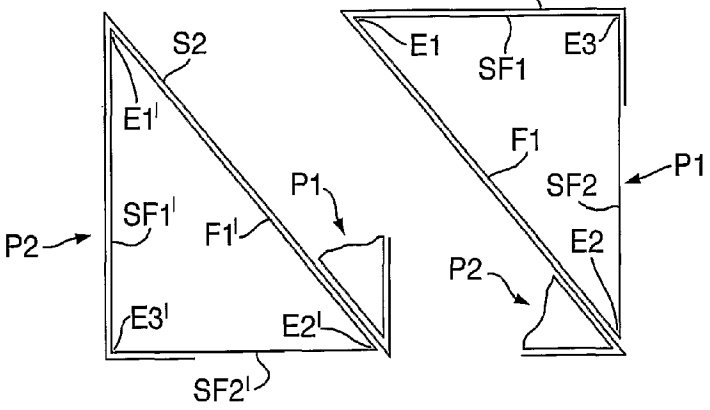
Figure 28A:
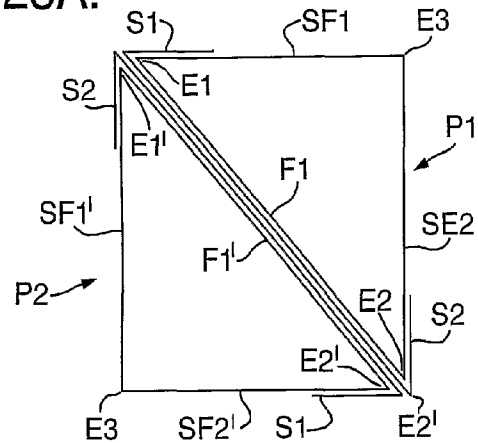
Figure 28B:
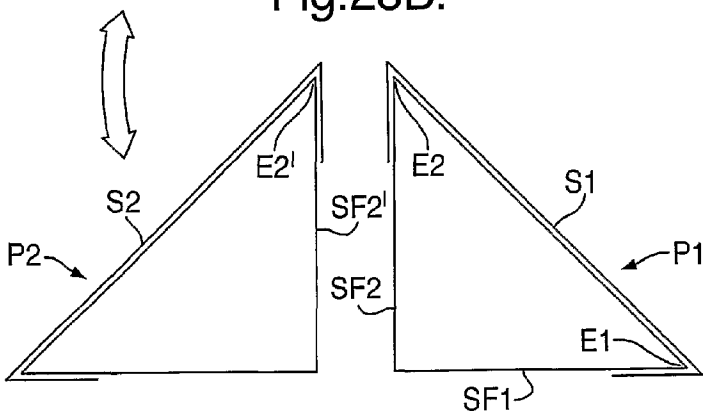

FIG. 27 is a perspective view of a ninth example of a package, wherein each pack forming the package has a hinged lid; and FIG. 28A to 28C illustrate a package arrangement in which each pack is of triangular cross-section.

OVERVIEW

Figure 1A:
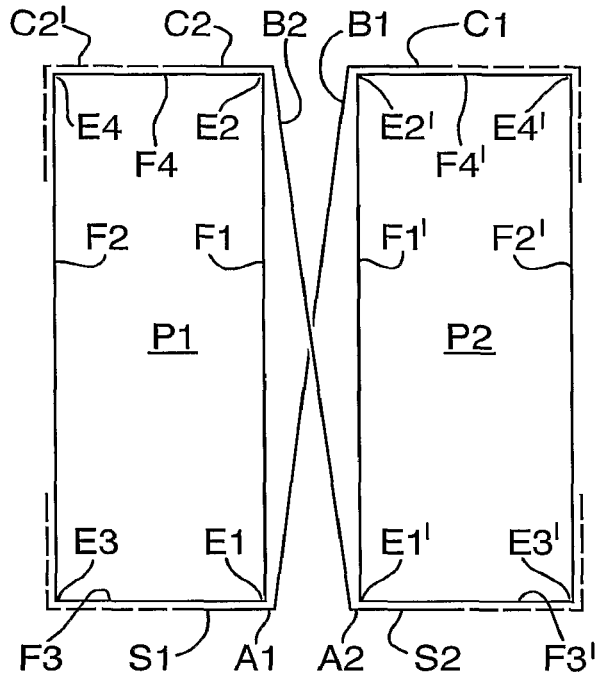
Figure 1B:
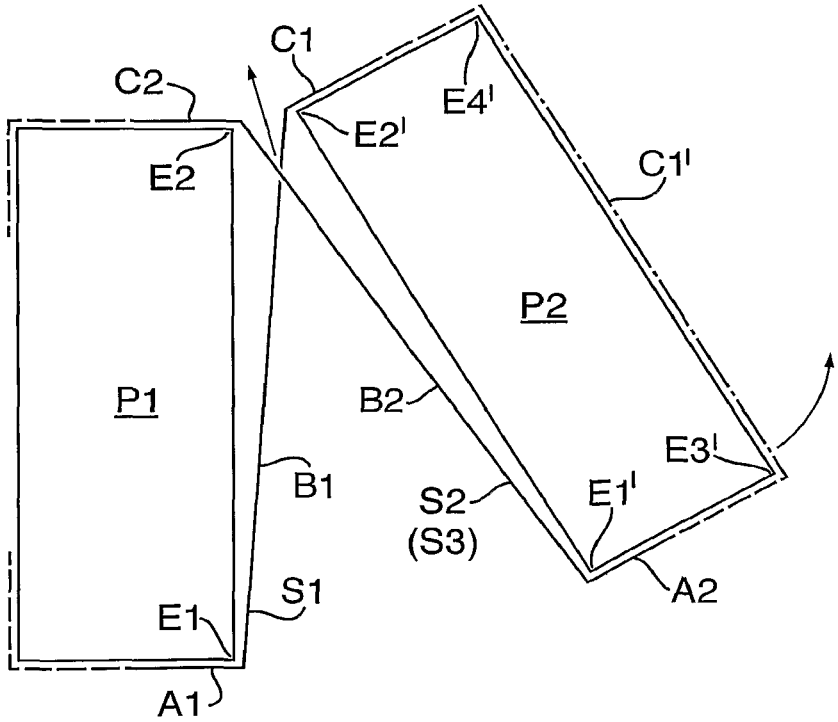
Figure 1C:
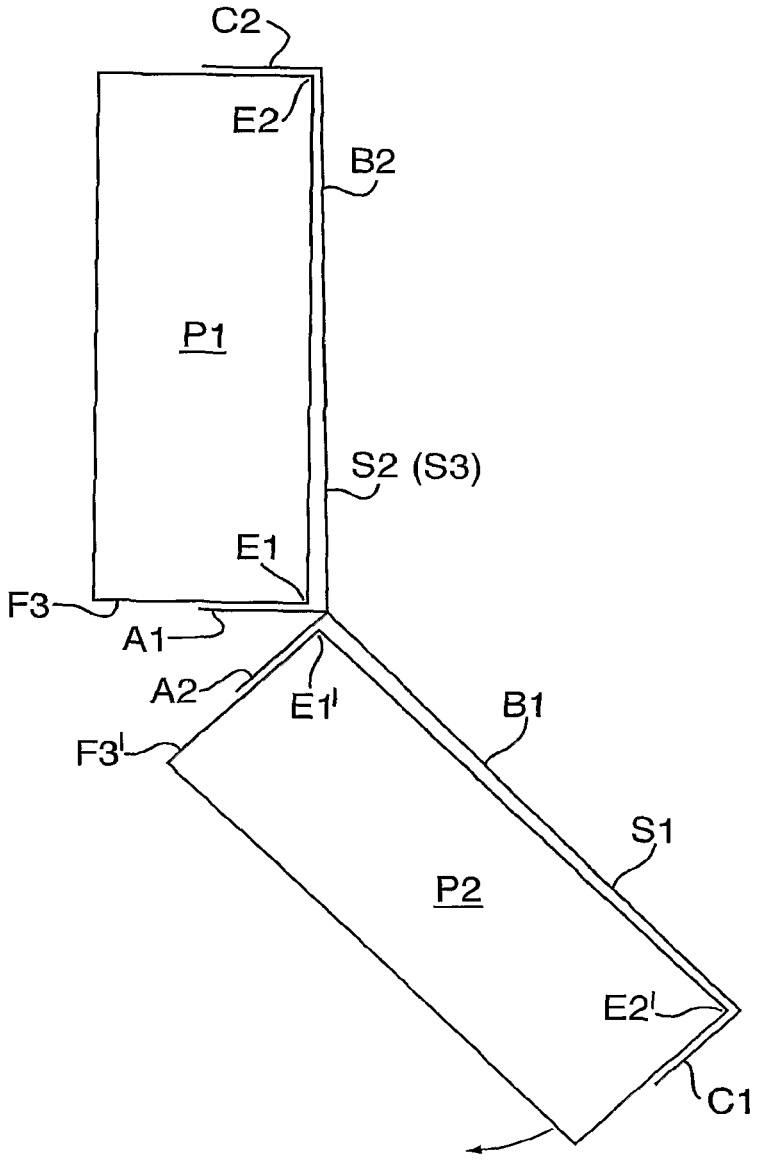

The first package comprises two packs P1 and P2. In this example the packs are closed boxes each containing cigarettes. The two packs are joined in a "Jacobs ladder" arrangement which allows each pack to rotate about the other as shown in FIGS. 1B and 1C. Thus referring to FIGS. 1A and 1B, assuming pack P1 is stationary, starting at the position shown in FIG. 1A, in which the faces F1 and F1' of the two packs face one another, pack P2 is able to rotate about edge E2 of pack P1 in an anticlockwise direction. As shown in FIG. 1C, pack P2 is also able to rotate in a clockwise direction about edge E1 of pack P1. In one example either one of the two packs can move relative to other from the position shown in FIG. 1A through 180° to be side by side with the faces F1 and F1' facing in the same direction. In another example either one of the two packs can move relative to other from the position shown in FIG. 1A through 360° to be side by side with the faces F1 and F1' facing in opposite directions: i.e. as shown in FIG. 1A but with P2 to the left of P1. These and other examples will be described in more detail in the following description.

FIRST EXAMPLE

Referring to FIG. 1A, in a first example, the two packs P1 and P2 are joined by at least two straps S1 and S2. The following discussion initially assumes there are two straps. Pack P1 is of rectangular cross section having a base, a front face F1, a rear face F2 and side faces F3 and F4 upstanding from the base. Faces F1 and F3 have an edge E1 in common; faces F1 and F4 have an edge E2 in common; faces F2 and F3 have an edge E3 in common; and Faces F2 and F4 have an edge E4 in common. Pack P2 is identical its faces and edges being identified by the same references as pack P1 but with a suffix '. The edges E1 to E4 and E1' to E4' upstand from the bases of the packs. Strap S1 is: fixed to P1 at face F3 and extends freely around edge E1, between and across the faces F1 and F1' to edge E2' of pack P2 and around edge E2' of P2 and is fixed at face F4' of pack P2. Strap S2 is fixed to P1 at face F4 and extends freely around edge E2, between and across the faces F1 and F1' to edge E1' of pack P2 and around edge E1' of pack P2 and is fixed at face F3' of pack P2.

As shown in FIG. 1B, this allows pack P2 to rotate about edge E2 of pack P1 in an anticlockwise direction. In the position shown in FIG. 1A, the straps S1 and S2 extend in diagonally opposite directions between the two packs, the straps crossing centrally between the two packs. As pack P2 rotates anti-clockwise about edge E2, the crossing point moves towards E2. The rotation ceases when faces F4 and F4' face one another. As shown in FIG. 1C, the pack P2 can rotate in similar manner about edge E1 in a clockwise direction until faces F3 and F3' contact each other.

A minimum of two straps are needed. However, three straps may be provided, with strap S1 in between the other two straps S2 and S3, as is shown in further examples described hereinafter.

The straps may be of any thin flexible material. If only two straps are used, then the material used is stiff transversely of the long direction of the straps. More than three straps may be provided.

As will be described below, the straps have two sides and at least the parts B1 and B2 of the straps are visible in different positions of the straps and can be used for indicia and/or graphics

BLANK AND SECOND EXAMPLE

Figure 2B:
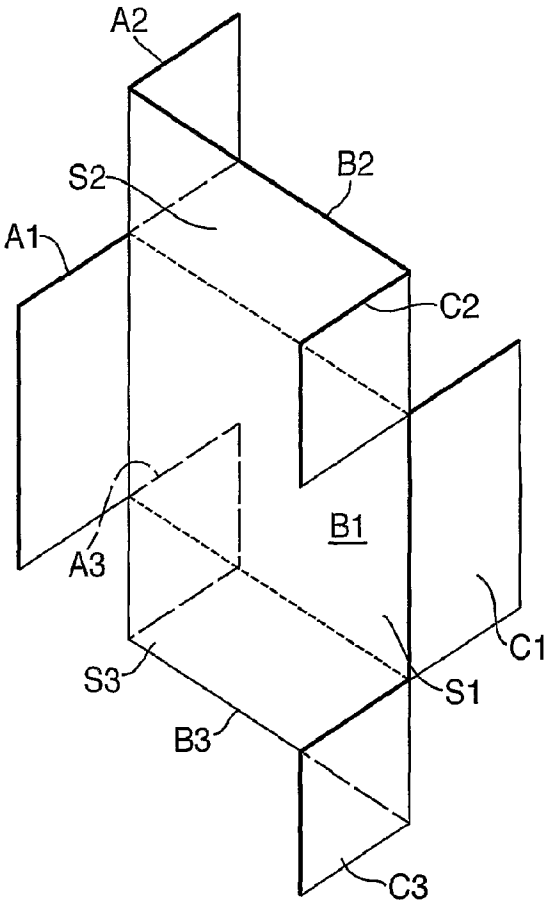
FIG. 2B is the blank of FIG. 2A folded as in use.
Figure 2A:
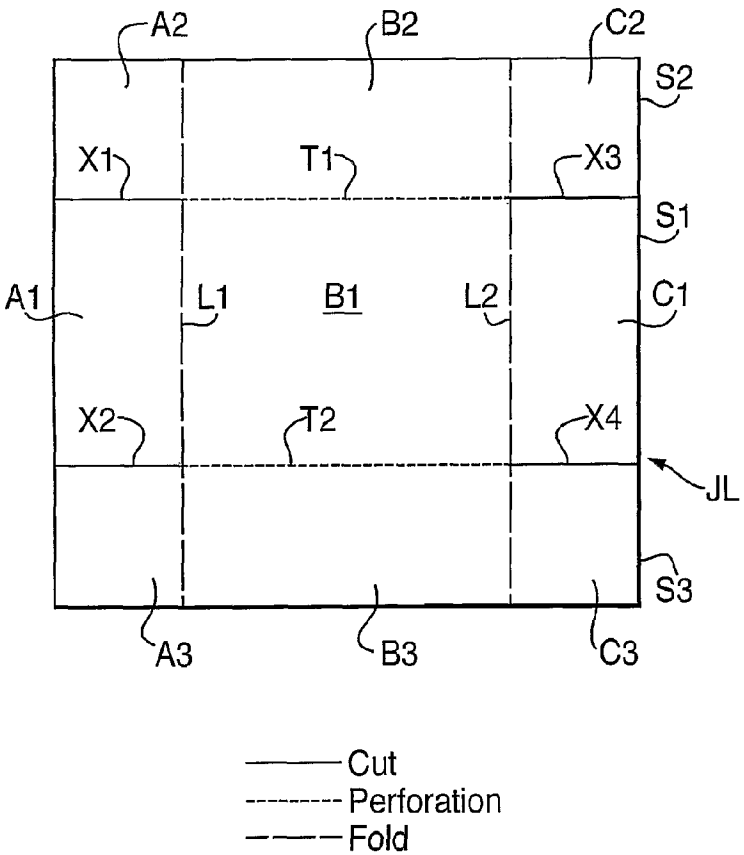
FIG. 2A is a plan view of a blank useful in the packages of FIG. 1.

FIGS. 2A and B show a blank of material which may be used to join two packs P1 and P2 using three straps S1 to S3 in a Jacobs ladder arrangement in a second example of the invention. FIG. 2A shows the blank before use. FIG. 2B shows the blank folded into the configuration of its use. The blank is generally rectangular. Strap S1 is, in this example, between straps S2 and S3, and in this example is wider than each of the other two straps. Strap S1 comprises flaps A1 and C1 which in use are fixed to face F3 of pack P1 and face F4' of pack P2 respectively, and band B1 which extends from face F3 freely across faces F1 and F1' to face F4'. Strap S2 comprises flaps C2 and A2 which in use are fixed to face F4 of pack P1 and face F3' of pack P2 respectively, and band B2 which extends from face F4, freely between the faces F1 and F1', to face F3'. Similarly, strap S3 comprises flaps C3 and A3 which in use are fixed to face F4 of pack P1 and face F3' of pack P2 respectively, and band B3 which extends from face F4, freely across faces F1 and F1', to face F3'. Flaps A1 and A2 are separated by a cut X1. Flaps A1 and A3 are separated by a cut X2. Similarly, flap C1 is separated from C2 and C3 by cuts X3 and X4. Band B1 is joined in the blank to bands B2 and B3 by perforated tear lines T1 and T2. The flaps A1 to A3 and C1 to C3 are joined to the bands B1 to B3. In some examples such as those of card or paper the flaps are joined to the bands by fold lines L1 and L2. In other examples, such as those of film, there are no fold lines.

Figure 2C:
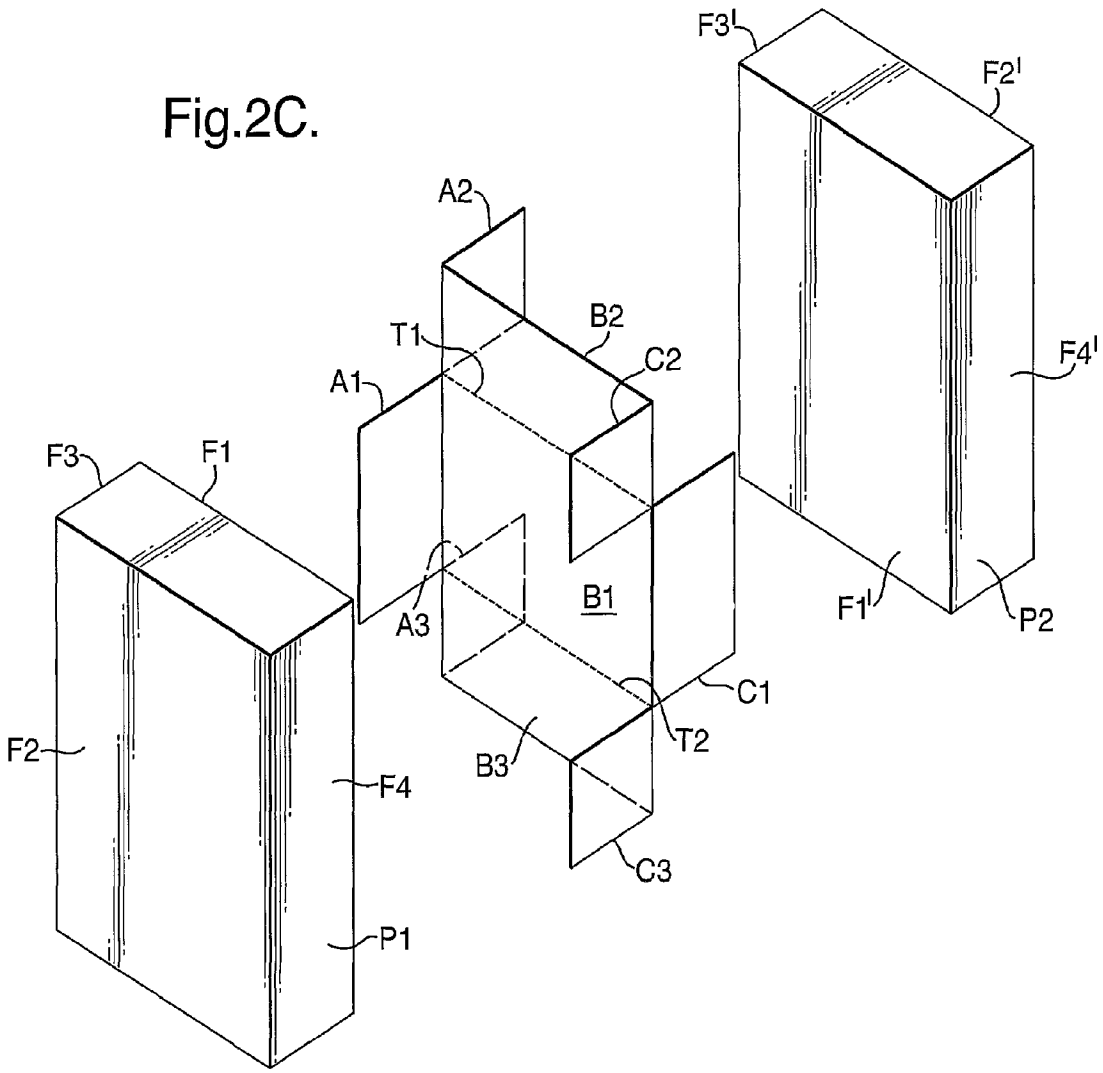
FIG. 2C shows the folded blank of FIG. 2B related to two packs.

Referring to FIG. 2C, in use the blank is fixed in one piece to the two packs P1 and P2 with the flaps A1 to A3 and C1 to C3 adhered (e.g. glued or heat sealed) to the edges of the packs as described above. It will be appreciated that if FIG. 1 is regarded as a top view FIG. 2C is a bottom view (or vice versa).

To open the package, the user rotates the packs one relative to the other That breaks the perforations along the tear lines T1 and T2.

THIRD EXAMPLE AND BLANK

Figure 2D:
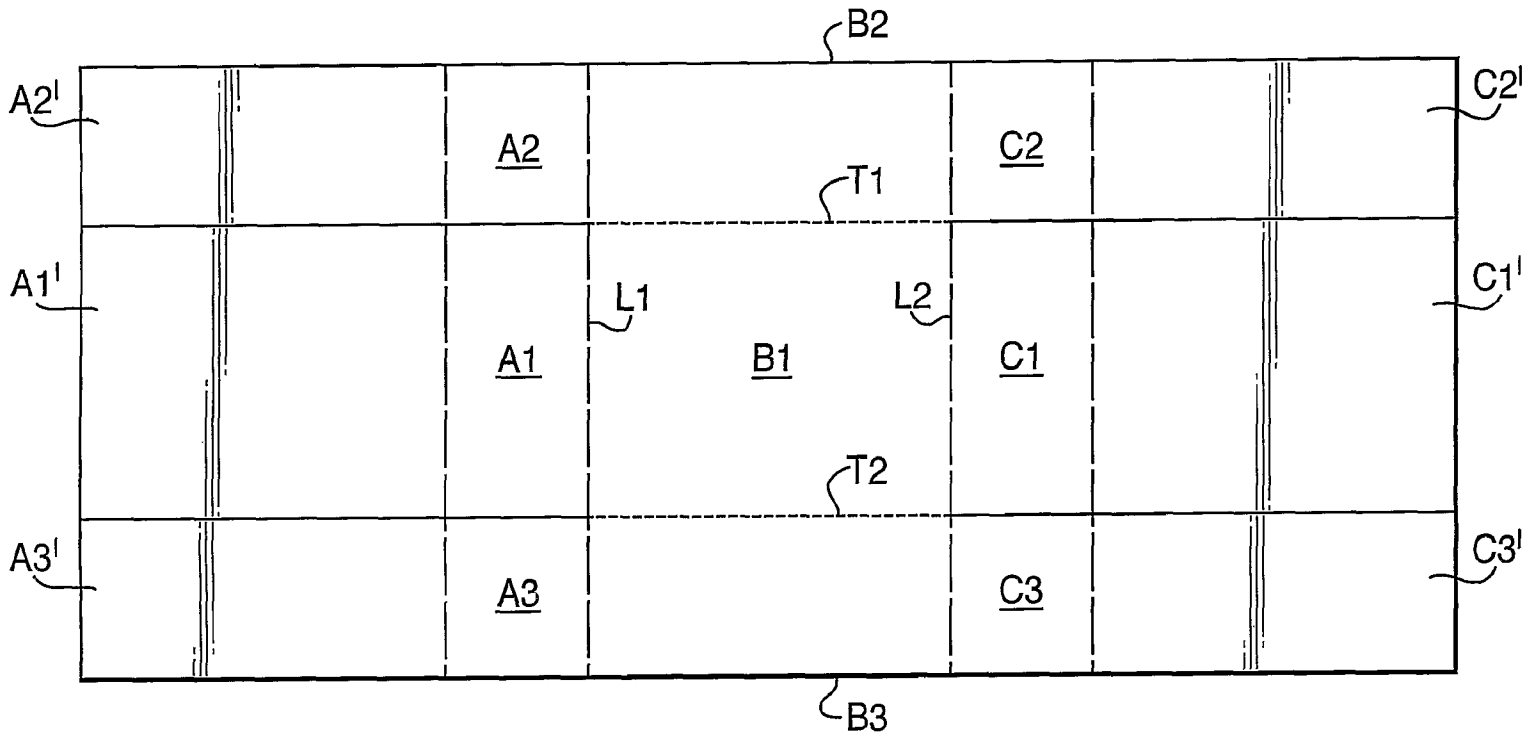
FIG. 2D shows a modification of the blank of FIG. 2A.
Figure 2E:
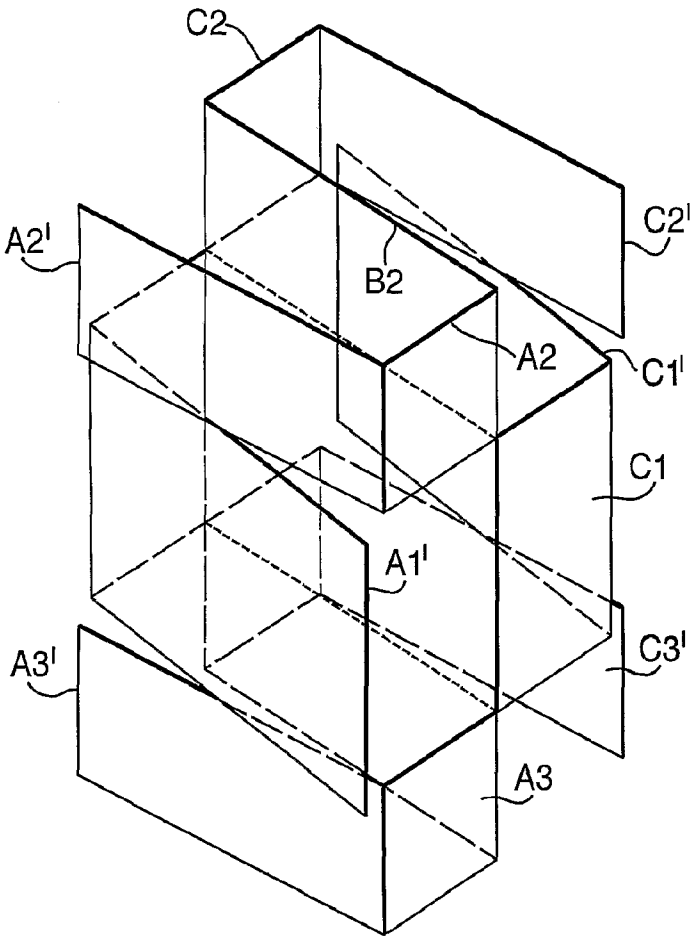
FIG. 2E shows the blank of FIG. 2D folded as in use.

As shown in FIG. 1 by the dashed lines, and in FIGS. 2D and 2E, the flaps A1 to A3 and C1 to C3 may be lengthened as indicated by A1' to A3' and C1' to C3' to extend freely across faces F3, F4, F3' and F4' and be fixed to faces F2 and F2'. That allows either one of the two packs to rotate through 360° relative to the other. In another version, the flaps A1 to A3 and C1 to C3 are fixed to the sides of the packs as shown in FIGS. 2A and 2B and the extensions A1' to A3' and C1' to C3' are glued.

FOURTH EXAMPLE AND BLANK

Figure 3B:
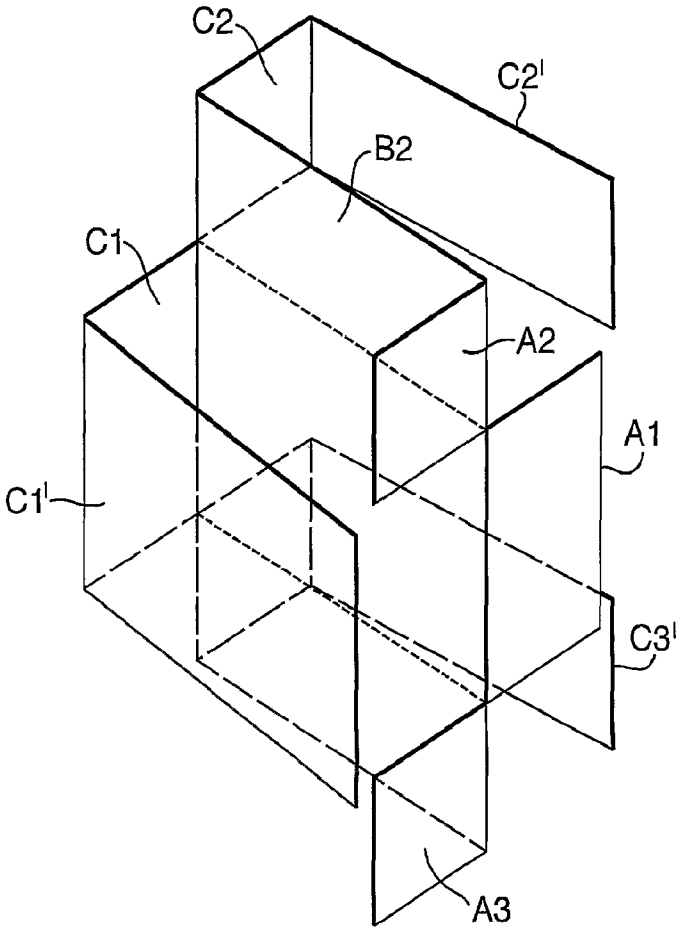
FIG. 3B shows the blank of FIG. 3A folded as in use.
Figure 3A:
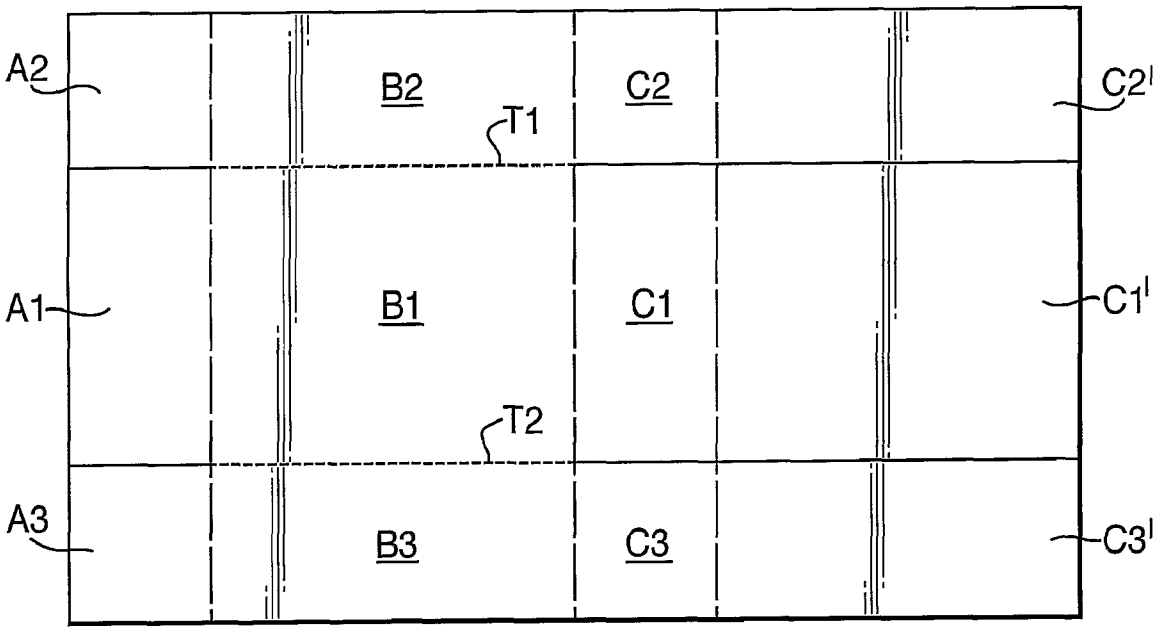
FIG. 3A is a plan view of another blank useful in the packages of FIG. 1.

As shown in FIGS. 3A and B, and in FIG. 1B at least one of the extensions C1' to C3' may extend over face F2' of pack P2. In some versions, the flaps A1, A2 and A3 are adhered to the sides F4', F4, and F4 respectively of the packs P2 and P1, the extensions C1', C2' and C3' are glued. In other versions the extensions C1', C2' and C3' are adhered to the faces F2', F2 and F2 respectively, the flaps C1, C2 and C3 being not adhered to the sides F4', F4 and F4. Any one or more of the extensions C1', C2' and C3' may carry indicia and/or graphics on one or both sides thereof.

The extensions C1', C2' and C3' could be free.

VARIANTS OF THE FIRST TO FOURTH EXAMPLES

The packs P1 and P2 may be wrapped in plastics wrapping, for example cellophane, polypropylene or other suitable material. The blank of FIG. 2 or 3 may also be of such plastics material fixed to the plastics wrapping of the packs.

The packs may be of card as is conventional in the art and the blank of FIG. 2 or 3 may be of card or paper fixed to the card packs. The resulting combined package may be wrapped in plastics wrapping. Instead of being integral parts of a blank, the straps may be separate ab initio.

Method of Making a Package—FIGS. 4A and 4B

A package as described above with reference to FIGS. 1, 2A, 2B and 2C may be made in the following way.

Packs P1 are supplied by a suitable conveyor to a station at which the joining blank JL is applied ST1 to each pack P1. In this example the blanks JL are cut from a reel of material. In another example the blanks JL are pre-cut and stored in a magazine. They are fed from the magazine and applied to the packs. The perforations and cuts may be pre-formed in the reel of material or formed at the station from plain material. In this example the blank JL is adhered to the leading edge of a pack by adhering the flaps C3 and C2 of the outer straps S3 and S2 to the pack P1. The blank JL is then cut to length ST2. The first packs P1 with blanks JL adhered thereto are conveyed to a station at which second packs P2 are placed ST3 onto the blanks JL. In FIG. 4A the second packs P2 are fed onto the first packs P1 from one side ST3 of the conveyor. In FIG. 4B the second packs P2 are placed ST3' onto the first packs P1 from above ST4'. In the following steps ST4 (or ST4') to ST8, the blank JL is adhered to the first P1 and second packs P2 to connect them in a Jacobs Ladder arrangement.

In step ST4 and ST4' the two packs P1 and P2 with the blank JL between them are indexed together, i.e. transported and accurately aligned.

In the example illustrated in steps ST5 and ST6 the two packs P1 and P2 move vertically down through guides, or via a rotary mechanism, which fold the flaps C1, A2 and A3 upwards and in step ST7 heater bars adhere the flaps C1, A2 and A3 to the packs. In step ST8 the packs move vertically upwards through guides which fold the remaining flap A1 down and in step ST9 flap A1 is adhered to the package by a heater bar.

Alternatively, the steps ST5 to ST9 may be combined wherein the vertical movement causes flaps A1, A2, A3 and C1 to fold simultaneously in the desired direction and to be adhered to the package by the heater bar.

FIFTH EXAMPLE

FIGS. 5 to 9

Referring to FIGS. 5, 8B, 8C and 9A and 9C, two packs P1 and P2 each comprise an inner shell I (FIGS. 8C and 9C) and an outer shell O (FIGS. 8B and 9A). The outer shell is a tube of rectangular cross section having front and rear major faces 2 and 4 and minor side faces 6 and 8. The inner shell comprises a rear wall 10, side flaps 12 and 14, top and bottom flaps 16 and 18 hinged to the rear wall 10, and tongues 20 and 22 hinged to the flaps 16 and 18. The inner shell co-operates with the outer to contain cigarettes. In the example shown, each pack P1, P2 contains one row of cigarettes, but other versions may contain more than one row. Other forms of pack P1 and P2 as known in the art can be used. For example each pack P1 and P2 may be a one part pack.

The two packs P1 and P2 are connected in a Jacobs Ladder arrangement by the structure shown in FIG. 9B in assembled form and in FIG. 8A in the form of a blank. The structure comprises walls R1 and R2 between which extend straps S2 and S3. Straps S2 and S3 are spaced apart, being separated by a predetermined distance D. The straps S2 and S3 comprise bands B2 and B3 connected to wall R1 by sections C2 and C3 and connected to wall R2 by sections A2 and A3. The walls R1 and R2 and the straps S2 and S3 define a rectangular hole of width D. A strap S1 extends from the centre of the side of wall R1 remote from the hole. Strap 51 has a width equal to or less than D. Strap 51 comprises a band B1 connected to wall R1 by section A1. A joining tab J is connected to band B1 by section C1 Band B1 passes through the hole between straps S2 and S3, and joining tab J is glued to the margin of face R2 remote from the hole to form a "Figure-of-8" structure as shown in FIG. 9B. The structure has two pack-containing sections: one defined by wall R2, strap sections C1, A2 and A3 and bands B1, B2 and B3; the other by wall R1, strap sections C2, C3, A1, and bands B1, B2 and B3. Each pack containing section contains a pack as shown in FIGS. 5 to 7. FIGS. 5 and 7 show the assembled packs as viewed in the direction of the arrow labelled "(FIG. 5A), (FIG. 7)" in FIG. 9B. FIGS. 6A and 6B show the packs P1 and P2 in different positions. It will be seen in FIGS. 6A and 6B that the strap S2 traps the tongue of the left hand pack P1 in FIG. 6A and P2 in FIG. 6B. Access is provided to the right hand pack; the left-hand pack can be accessed by rotating it around the other pack to put it on the right hand side. Of course the packs may be arranged so the left hand pack gives access to the cigarettes.

In a variant which uses "slide and shell" packs the straps do not need to trap the flaps because the slide allows for the inner part to be "slid" from within the outer shell in order to gain access to the cigarettes.

In this fifth example the blanks of FIGS. 8A to C are all of board known in the art. The blanks may be of any other suitable material, e.g. plastics material. In one version, the outer shells of the packs P1 and P2 are glued to the Jacobs Ladder structure. In another version, the packs are free to slide within the structure.

Whilst the blank of FIG. 8A is generally rectangular and has a rectangular strap S1 of width D1 which passes through the corresponding rectangular hole of width D, blanks 8C need not be rectangular. Strap S1 may have a periphery of any shape. The hole may have a periphery of any shape. The maximum width of the strap must be equal to or less than the minimum width of the hole to enable the strap S1 to pass through the hole. The strap S1 and hole need not be centred on the axis of the blank.

SIXTH EXAMPLE

FIGS. 10 to 16

The sixth example is a package which comprises two packs P1 and P2 connected in a Jacobs Ladder arrangement, the two packs sharing one hinged lid.

As shown in FIGS. 10 to 13, two packs P1 and P2 are connected together by a blank as shown in, and described with reference to, for example, FIG. 2. A lid L hingedly connected to one P1 of the packs closes the top of both packs P1 and P2.

FIGS. 14, 15 and 16 show blanks which are used to construct the package. FIG. 15A is a plan view of the joining blank JL used to join the two packs together. Joining blank JL is identical to that described with reference to FIG. 2. The blanks of FIGS. 14 to 16 are a modification of the blanks described in WO 2004/080844A1, the contents of which are incorporated herein by reference.

Pack P1 comprises two parts: part P11 shown in FIG. 14; and part P12 shown in FIG. 15B. Pack P2 comprises two parts: part P21 shown in FIG. 14; and part P22 shown in FIG. 15C. FIGS. 15B and C show the position the joining blank JL takes with respect to the blanks P12 and P22 which form parts of the packs P1 and P2.

Parts P11 and P21 are parts of a unitary blank BL which also includes the lid L. Part 21 comprises a main face F2' and side faces F3' and F4'. Part P21 is joined to part P11 by integral flaps 78 and 80. The flaps 78 and 80 are joined by a tear line T3. Part P11 comprises a main face F2 and side faces F3 and F4.

Part P11 is joined to the lid L via a fold line 82 which has additional weakening as indicated by 82'. The form of the lid is known; see for example WO 2004/080844 A1

The lid L comprises a rear wall 84, inner side walls 74 and 76, top wall 68, and front wall 62. Flap 60 is reinforcement for the front wall and flaps 70 and 72 connect the side walls 74 and 76 to the top wall. The lid further comprises outer side walls 64 and 66 which are reinforced by the inner side walls 74 and 76. Fold lines between the flaps and walls are indicated by dash lines in FIG. 14.

Part P12 is an inner part having an outer face 30 which corresponds to face F1. Outer face 30 is connected by a bottom wall 36 to an inner rear wall 38. Face 30 has side flaps 32 and 34. Rear wall 38 has side flaps 40 and 42.

Part P22 is another inner part having a face 44 which corresponds to face F1' and a rear wall 56. The rear wall 56 is connected to the face 44 by a bottom wall 50. The wall 56 has side flaps 52 and 54. The face 44 has side flaps 46 and 48.

Figure 16A:
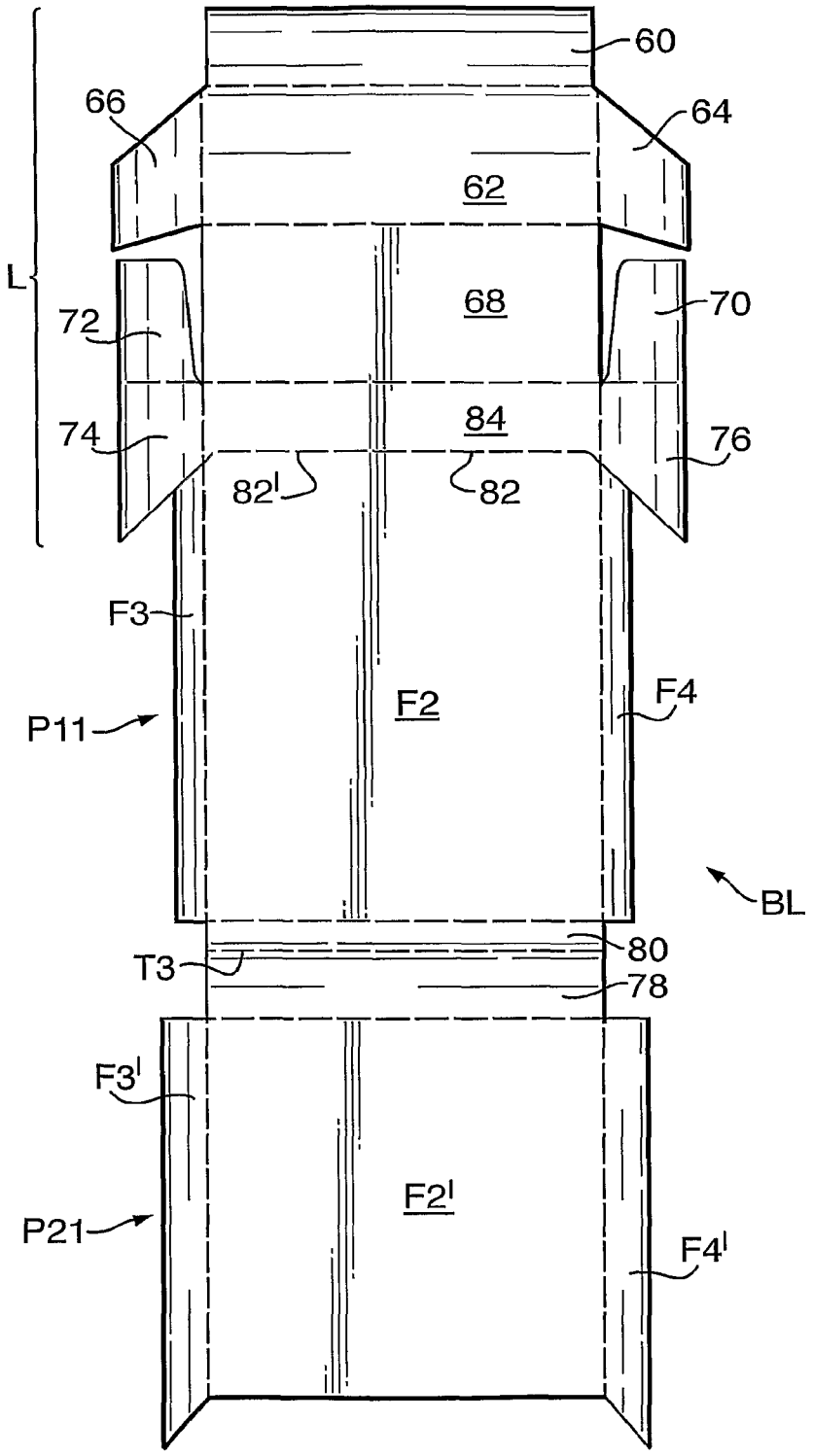
Figure 16B:
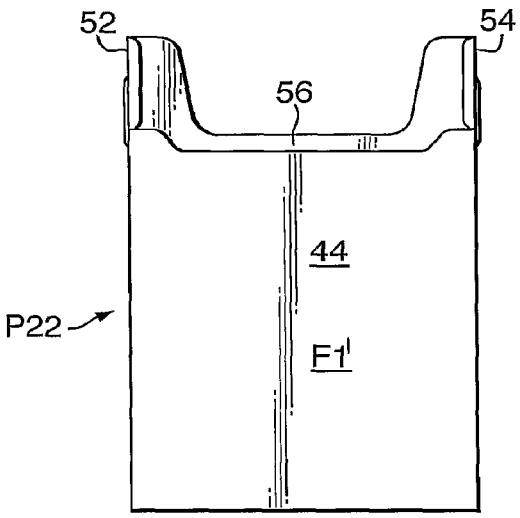
Figure 16C:
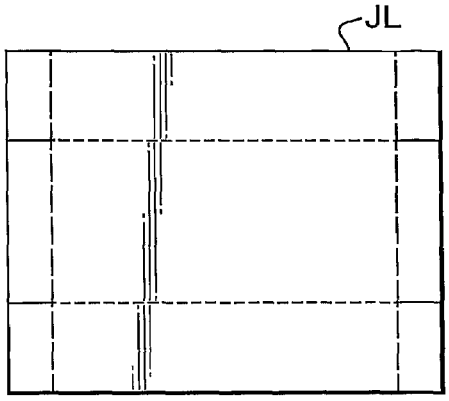

Referring to FIGS. 15C and 16B, the inner part P22 is assembled by folding the side flaps 46, 48, 52 and 54 at right angles to the face 44 and wall 56 along the fold lines indicated by dash lines in FIG. 15C. The face 44 and wall 56 are folded at right angles to the bottom wall 50 along the fold lines indicated in FIG. 15C. The side flaps 46 and 52 are glued to each other. The side flaps 48 and 54 are glued to each other. The resulting box is shown in FIG. 16B.

Figure 16D:
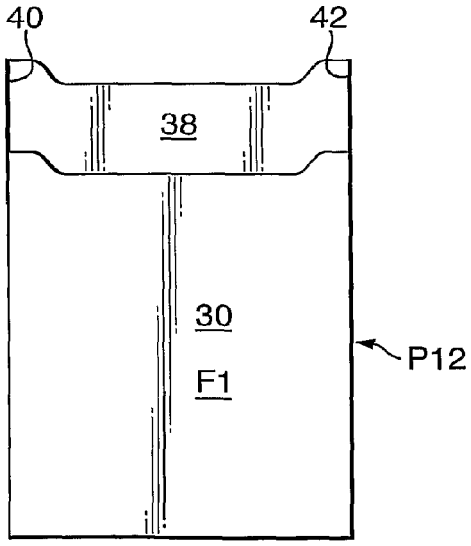

Referring to FIGS. 15B and 16D, the inner part P12 is assembled by folding the side flaps 32, 34, 40 and 42 at right angles to the face 30 and wall 38 along the fold lines indicated by dash lines in FIG. 15B. The face 30 and wall 38 are folded at right angles to the bottom wall 36 along the fold lines indicated in FIG. 15B. The side flaps 40 and 34 are glued to each other. The side flaps 32 and 42 are glued to each other. The resulting box is shown in FIG. 16D.

The joining blank JL is positioned as shown in FIGS. 15B and C relative to the faces F1 and F1' on the inner parts P12 and P22. Flaps A2 and A3 of the joining blank are fixed to side flap 32 of the inner part P12. Flap C1 of the joining blank is fixed to side flap 34 of the inner part P12. Flaps C2 and C3 of the joining blank are fixed to side flap 48 of the inner part P22. Flap A1 of the joining blank JL is fixed to side flap 46 of the inner part P22. Then, the rear inner wall of part P22 is fixed on face F2' of the blank BL (FIG. 14) with the bottom wall 50 on bottom wall section 78. The side flaps F3' and F4' of the blank BL are glued to the side flaps of the inner part P22. The rear inner wall 38 of part P12 is fixed on face F2 of the blank BL with the bottom wall 36 on bottom wall section 80. The side flaps F3 and F4 of the blank BL are glued to the side flaps 32 and 34 of the inner part P12 The faces 44 and 30 of the inner parts P22 and P12 respectively form the faces F1 and F1' of the packet.

Alternatively, the joining blank JL may be connected directly to the side flaps F3, F3', F4 and F4' of the main blank BL. The inner parts P12 and P22 when assembled may slide between the faces F2 and the joining blank JL and face F2' and the joining blank JL respectively. The inner parts P12 and P22 will come to rest against the bottom panels 80 and 78 respectively. In this arrangement, gluing inner parts P12 and P22 directly to the main blank BL and/or joining blank JL is not necessary.

The lid L is formed by folding inner side walls 74 and 76 together with the flaps 70 and 72 to right angles to the rear wall 84 about the fold lines at the sides of the rear wall. Flaps 70 and 72 are folded inwardly at right angles to the inner rear walls 74 and 76. Reinforcement flap 60 is folded onto the inside of the front wall 62 and fixed to it. Top wall 68 is folded about the fold line between it and the rear wall 84 onto the flaps 70 and 72 and in this example fixed to the flaps 70 and 72. In other example the flaps 70 and 72 are free. Front wall 62 is folded down to be at right angles to the top wall. Outer side walls 64 and 66 are folded and fixed to the inner side walls 74 and 76.

Referring to FIG. 10, the assembled, but un-opened package has the packs P1 and P2 joined by the bottom wall sections 78 and 80 with the tear line T3 intact. Furthermore the strap S1 is joined to the straps S2 and S3 with the tear lines T1 and T2 intact. The package is opened by opening the lid L and rotating the pack P2 relative to pack P1 separating the bottom wall sections 78 and 80 along the tear line T3 and separating the strap S1 from strap S2 and S3 along the tear lines T1 and T2.

Referring to FIG. 16A, in another version of the example, the part P21 is initially separate from the part P11; i.e. the blank BL is replaced by two blanks being in effect separated along the tear line T3.

In yet another version, the tear line T3 remains intact during construction and is slit by machine, i.e. the line T3 is cut "online". The pack delivered to the consumer has separate parts P11 and P21.

The joining blank is of such a size and is so positioned that the lid L can be opened without damaging the straps of the joining blank.

Method of Making the Package of FIGS. 10 to 16

The sixth example may be made as follows. The two packs P1 and P2 may be connected in the Jacobs Ladder arrangement as described with reference to FIG. 4. The blank of FIG. 14 is folded around the joined packs P1 and P2.

SEVENTH EXAMPLE AND BLANKS

FIGS. 17 to 22

The seventh example and its blanks are a variant of the fifth example of FIGS. 4 to 9. The seventh example differs from the fifth example mainly in that it is intended to connect two conventional hinged lid packs P1 and P2 which may be wrapped in plastics wrapping.

The two packs P1 and P2 are connected in a Jacobs Ladder arrangement by the structure shown in FIG. 22 in assembled form and in FIG. 21 in the form of a blank. The structure comprises walls R1 and R2 between which extend straps S2 and S3. Straps S2 and S3 are spaced apart being separated by a predetermined distance D. The straps S2 and S3 comprise bands B2 and B3 connected to wall R1 by sections C2 and C3 and connected to wall R2 by sections A2 and A3. The walls R1 and R2 and the straps S2 and S3 define a rectangular hole of width D. A strap S1 extends from the centre of the side of wall R1 remote from the hole. Strap S1 has a width equal to or less than D. Strap S1 comprises a band B1 connected to wall R1 by section A1. A joining tab J is connected to band B1 by section C1. Band B1 passes through the hole between straps S2 and S3, and joining tab J is glued to the margin of face R2 remote from the hole to form a "Figure-of-8" structure as shown in FIG. 22. The structure has two pack-containing sections: one defined by wall R2, strap sections C1, A2 and A3 and band B1 of strap S1; the other by wall R1, strap sections C2, C3, A1, and bands B2 and B3. Each pack containing section contains a known hinged lid pack FIGS. 18 and 19 show the packs P1 and P2 in different positions. As indicated by G1 and G2 which identify the sides of the straps, graphics and/or indicia may be provided on both sides of one or more of the straps. Also, as indicated by G3, G4, G5 and G6 areas of the first faces of the packs are available for indicia and/or graphics.

As shown in FIGS. 21 and 22, the structure for containing the packs optionally comprises two bottom walls BB comprising bottom walls sections BB1 and BB1' connected to those side edges of the walls R1 and R2 which in use are the bottom edges of the combined packs. The bottom wall sections have apertures FH for allowing the user to push, using his or her finger, a pack P1 or P2 out of the section of the Figure-of-8 containing it. Tabs BB2 and BB2' are connected to the bottom walls BB1 and BB1'. The tabs are folded upwardly into the Figure-of-8 sections to hold the bottom walls in place.

Preferably the straps are so sized and positioned that the lids of the packs can be opened without damaging the straps.

EIGHTH EXAMPLE

FIGS. 23A to 23D, FIGS. 24A to 24E, FIGS. 25A to 25C and FIGS. 26A to 26D The blanks illustrated in FIGS. 23 to 26 may be used to make variants of the package provided by the sixth example. The sixth and eighth examples comprise two packs P1 and P2 connected in a Jacobs Ladder arrangement; the two packs share one hinged lid L.

Referring to FIGS. 10 to 13 the two packs P1 and P2 are connected together with the lid section L being provided on the rear most face of the assembled pack. The arrangement is common to all the variants providing the eighth example. The differences between the variants of the eighth example is the number of and arrangement of the blanks forming the assembled package.

Figure 23B:
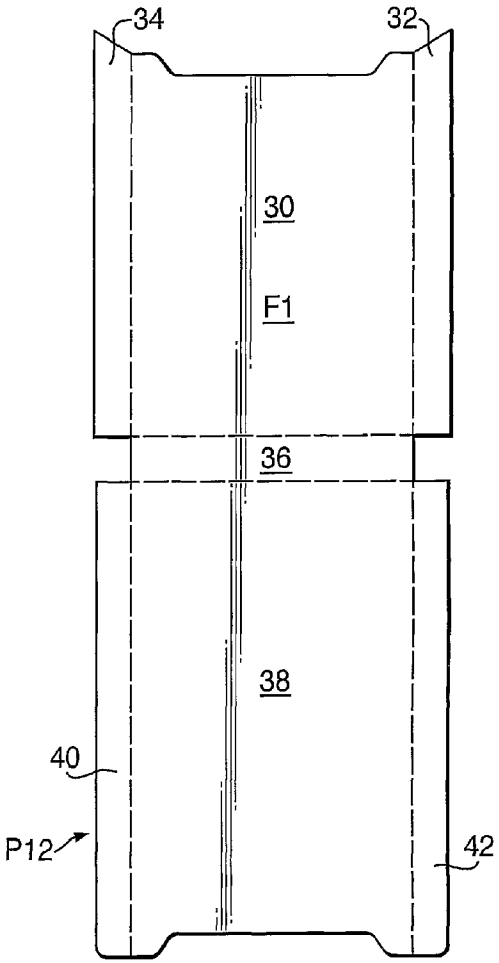
Figure 23A:
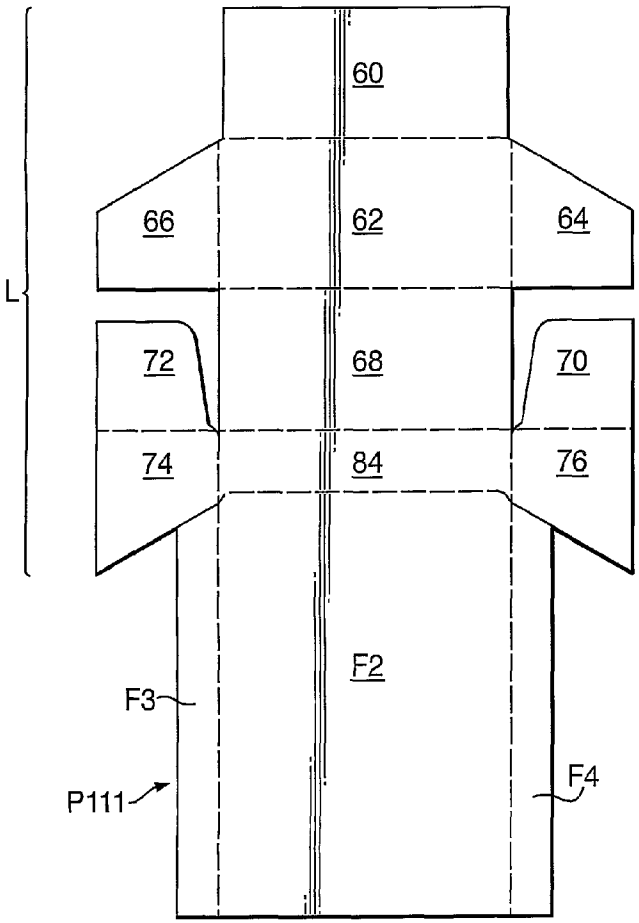

The first variant of the eighth example is shown in FIGS. 23A to 23D. FIG. 23A illustrates a blank P111 which provides an outer casing to the assembled pack and also provides the lid portion L. The blank in FIG. 23A varies from that of the sixth example by removal of the part of the outer casing provided by blank BL that covers the inner part P22 when the pack is assembled.

In the first variant of the eighth example the blanks P12, P22 and the joining blank JL are combined in an identical manner to that of the sixth example as described above.

Figure 23C:
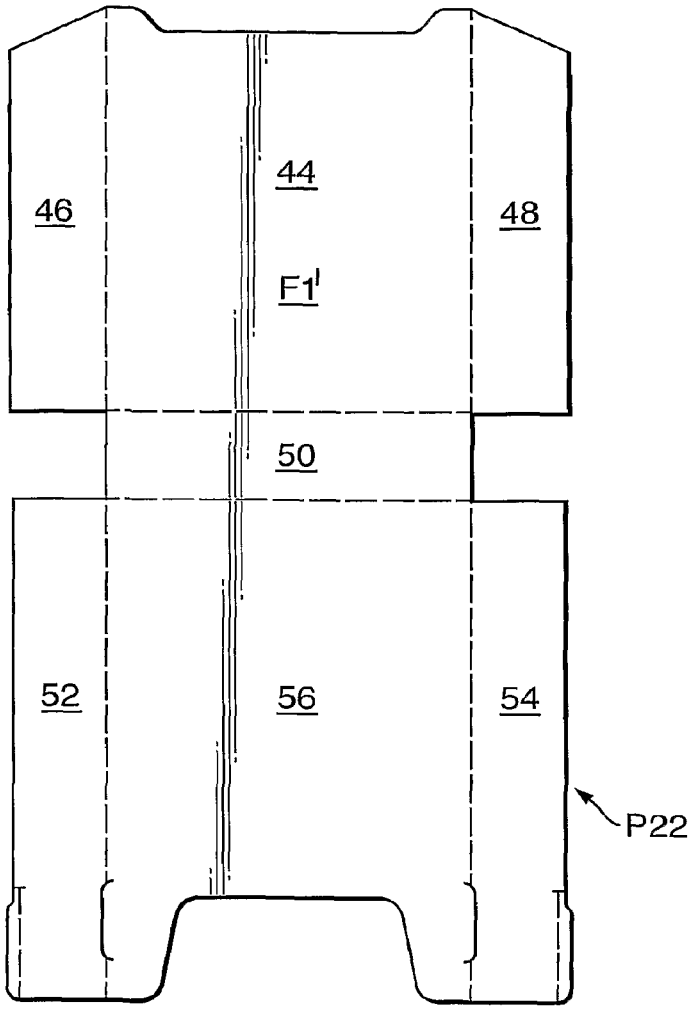
Figure 23D:
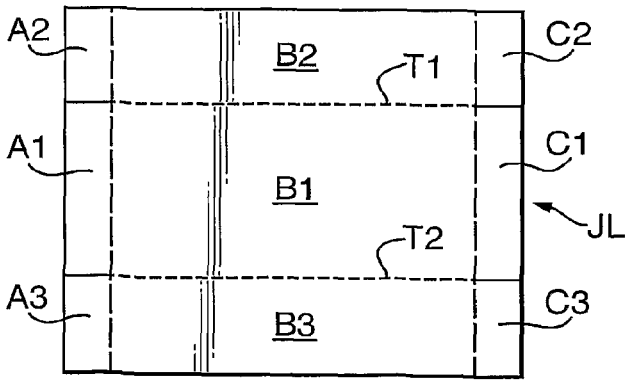
Figure 24B:
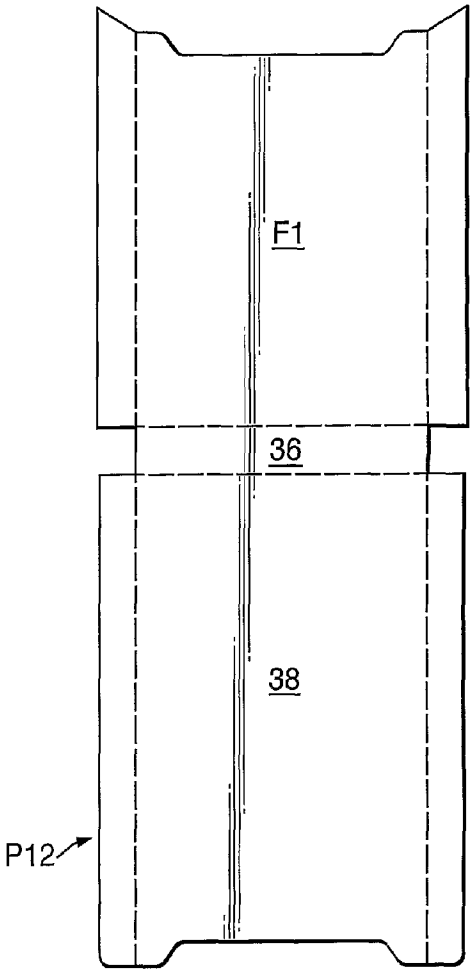
Figure 24A:
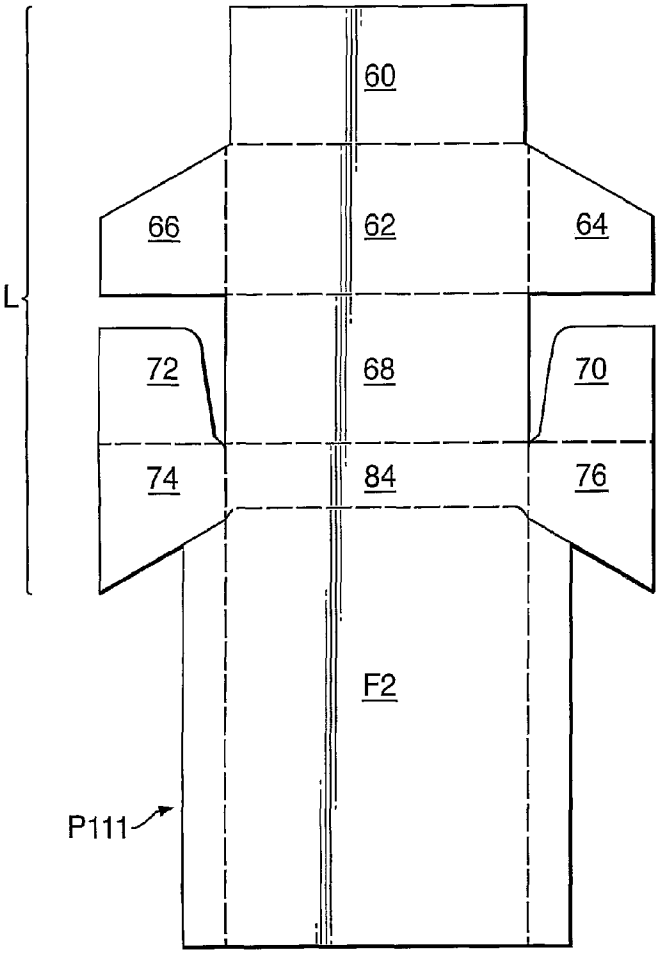
Figure 24D:
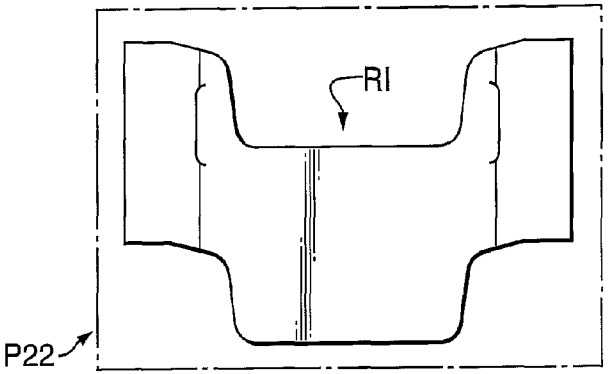
Figure 24E:
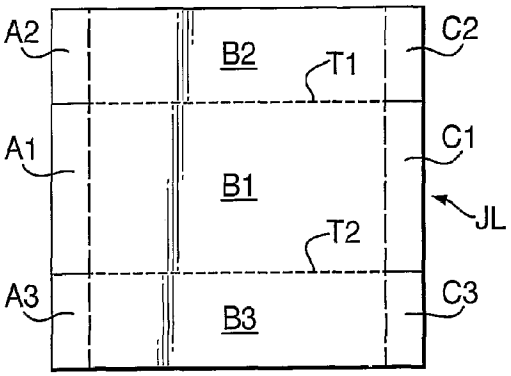
Figure 24C:
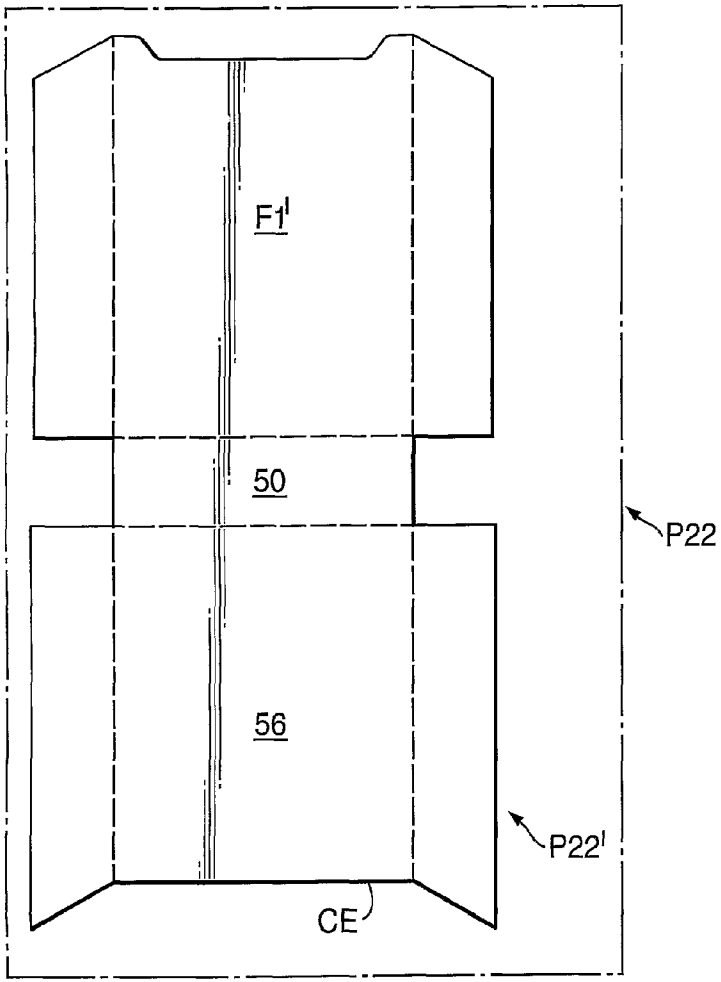

Referring to the sixth example, FIG. 23B, FIG. 23C and FIG. 23D correspond with FIGS. 15B, 15C and 15A respectively. Therefore, referring to FIGS. 15C and 16B, the inner part P22 is assembled by folding the side flaps 46, 48, 52 and 54 at right angles to the face 44 and wall 56 along the fold lines indicated by dash lines in FIG. 15C. The face 44 and wall 56 are folded at right angles to the bottom wall 50 along the fold lines indicated in FIG. 15C. The side flaps 46 and 52 are glued to each other. The side flaps 48 and 54 are glued to each other. The resulting box is shown in FIG. 16B.

The joining blank JL is positioned as indicated in FIGS. 15B and 15C relative to the face 30 (F1) and 44 (F1') on the inner parts P12 and P22 (FIGS. 23B and 23C). Referring to FIGS. 15B and 16D, the inner part P12 is assembled by folding the side flaps 32, 34, 40 and 42 at right angles to the face 30 and wall 38 along the fold lines indicated by dash lines in FIG. 15B. The face 30 and wall 38 are folded at right angles to the bottom wall 36 along the fold lines indicated in FIG. 15B. The side flaps 40 and 34 are glued to each other. The side flaps 32 and 42 are glued to each other. The resulting box is shown in FIG. 16D.

The inner part assembly, which comprises the inner parts P12 and P22 joined together by the joining blank JL are then attached to the blank P111 providing an outer casing and the lid L. The face 38 that provides the rear wall of the inner part 12 is glued to the rear face F2 of the casing blank P111.

In the first variant of the eighth example the face 56 of inner part P22 provides the external face of the closed package and panels 36 and 50 of inner parts P12 and P22 respectively provide the external bottom panels of the closed package.

The lid L is formed in exactly the same was as described with reference to the sixth example. Flaps A2 and A3 of the joining blank are fixed to side flap 32 of the inner part P12. Flap C1 of the joining blank is fixed to side flap 34 of the inner part P12. Flaps C2 and C3 of the joining blank are fixed to side flap 48 of the inner part P22. Flap A1 of the joining blank JL is fixed to side flap 46 of the inner part P22.

The lid L is formed by folding inner side walls 74 and 76 together with the flaps 70 and 72 to right angles to the rear wall 84 about the fold lines at the sides of the rear wall. Flaps 70 and 72 are folded inwardly at right angles to the inner rear walls 74 and 76. Reinforcement flap 60 is folded onto the inside of the front wall 62 and fixed to it. Top wall 68 is folded about the fold line between it and the rear wall 84 onto the flaps 70 and 72 and in this example fixed to the flaps 70 and 72. In another example the flaps 70 and 72 are free. Front wall 62 is folded down to be at right angles to the top wall. Outer side walls 64 and 66 are folded and fixed to the inner side walls 74 and 76.

A second variant of the eighth example is formed by folding and combining the blanks illustrated in FIGS. 24A to 24E.

The difference between the first and second variant is that the inner part 22 is divided into two parts P22' and RI. The inner part 22' has been modified such that the reinforcing inner insert RI is attached to the inside of face 56 that forms the interior wall of the assembled inner pack P22 such that an overlapping section is provided at CE, which overlapping section provides a closing edge CE against which the lid abuts on closing. The two parts forming the assembled inner part P22 (P22' and RI) provide a reinforced section such that the pack maintains its form when empty and also assists in keeping the lid closed in use.

Other than adjoining the reinforcement inner part RI to the inner part P22' to provide an inner part which has identical form of P22 (FIGS. 23A to D) the package of the second variant is formed in exactly the same way as the first variant. Inner parts P12, P22 and joining blank JL are combined, wherein panels F2 of part P111 and 56 of part P22' form the exterior faces F2 and F2' respectively of the assembled pack. The lid L is formed by folding the blank in the same manner as described above and with reference to FIG. 14. Like reference numerals have been applied.

The third variant of the eighth example dispenses with the outer casing section P111 or main blank BL as referred to above. The third variant, is formed of three blanks as illustrated in FIGS. 25A, 25B and 25C.

Referring to FIG. 25A, the lid portion L is formed as an extension of the inner part blank P12. The lid L is hingedly attached to the top edge of panel 38 of the inner part P12.

Referring to the description of the first variant of the eighth example above, the inner parts P12, P22 and the joining blank IL are combined in exactly the same way.

In the third variant, the faces 38 (F2) and 56 (F2') of the inner part P12 and P22 respectively provide the external faces F2 and F2' of the assembled pack. Panels 36 and 50 of the inner parts P12 and P22 respectively form the external bottom faces of the assembled pack.

The lid portion L is formed in exactly the same was as described above. Like reference numerals have been applied to FIG. 25A as in FIG. 14, FIG. 23A and FIG. 24A.

The fourth variant of the eighth example is formed by folding and combining the blanks illustrated in FIGS. 26A to 26D. In this example the blank forming inner part P22 has been divided into two parts P22' and RI. The reinforcement insert RI is adhered to the inside surface of the panel 56 such that an overlap is provided. The overlap defines a closing edge CE against which the leading closing edge of the lid abuts when closing the pack.

The package according to the fourth variant of the eighth example is formed by first combining inner part P22' and reinforcement inner RI to form inner part P22 and joining parts P22, P12' and the joining blank IL. As in the third variant, panels 38 and 56 form the exterior faces of the assembled closed pack.

The lid is formed identically to the method described above in respect of the sixth example and the first, second and third variants of the eighth example.

NINTH EXAMPLE

FIG. 27

FIG. 27 illustrates a variant of the seventh example utilising the joining blank JL of the sixth and eighth example.

In the ninth example two separate hinged lid packs HP1 and HP2 are combined. The two packs may be conventional hinged lid packs (example seven) or they may be adapted such that the combined dimensions of the two packs HP1 and HP2 correspond with those of a single conventional hinged lid pack.

The orientation of the packs as shown in FIG. 27 is where the closing edge CE of the packs HP1 and HP2 are on faces F1 and F1' such that the package is extended to access the contents of both packs.

Referring to FIGS. 15C and 16B the packs HP1 and HP2 are comparable with inner parts P12 and P22. The joining blank JL is attached to each of the hinged lid packs HP1 and HP2 in the same manner as illustrated in FIGS. 15C and 16B. The side flaps C2 and C3 and A1 are attached to the side panels of hinged lid pack HP2 (see FIG. 27) and the side flaps A2 and A3 and C1 are attached to the corresponding side panels of hinged lid pack HP1.

Variants

Straps

In the examples described above, the straps are initially provided connected together in a unitary blank. The straps may be separate ab initio.

At least two straps are needed. As described above three straps are used. Any number of two or more straps can be used.

Indicia and Graphics

Indicia and/or graphics may be provided on any of the outside walls of the package and on any face or wall of the packs in a package. In addition or alternatively, indicia and/or graphics may be provided on the straps. Indicia and/or graphics may be provided on both sides of at least one of the straps.

Contents

Packages in accordance with the invention may be used to contain objects other than smoking articles. The packets may be used for generally elongate cylindrical objects for example pencils and crayons. The packets may be used to store other objects which are not generally elongate and/or cylindrical.

The system of combining packs of cigarettes as described herein may also be applied to combining cartons of cigarettes; a carton being the package that contains packs of cigarettes. A carton is usually arranged with two rows of five packs of cigarettes and provides a package having a parallelepiped shape similar to a cigarette pack. The strap system for combining cigarette packs may be applied to combining two or more cartons together. The application of the strap system to the cartons would be particularly desirable for packaging cigarette packs, which utilise the strap system, because the packaging of the carton would be indicative of the packs it contains.

Smoking articles include cigarettes, cigars, and cigarillos amongst other such articles.

Shape of Packs and Edges

The packages and packs contained therein described by way of example above are generally rectangular with four faces upstanding from a rectangular base. A pack may have two major faces upstanding from a base, the two faces meeting at two edges. In the examples given above the edges are formed by faces at right angles. That is not essential to the invention: the packs and packages may have edges at least between the side walls and the front and rear walls which are rounded, bevelled, or elliptical, or other edge shapes including those known in the art.

The cross-sectional shape of the base of the pack containing for example cigarettes may be a shape other than rectangular, for example other quadrilateral shapes such as a square.

Two square packs may be combined with the strap system described above to provide a package having a rectangular base comprised of two squares arranged side-by side.

Alternatively, a three sided polygon may be applicable, that is to say a triangle. A triangular shaped base provides a suitable container for holding objects such as cigarettes. An example of a triangular shaped-base is illustrated in FIGS. 28A, 28B and 28C.

Referring to FIG. 28A, the triangular based packs P1 and P2 are illustrated simply in cross section. The packs are combined utilising the strap system described above. In the orientation illustrated the first face F1 and F1' of the first and second packs P1 and P2 respectively face each other such that the combined arrangement forms a package having a square base.

The strap system is applied to the packs by fixing one end of the first strap S1 to the side face SF1, extending the strap around the first edge E1 that adjoins the first side face SF1 to the first face F1, extending across the faces F1 and F1' that are facing each other and around the second edge E2' of the second pack P2 and fixing the strap to the second side face SF2' of the second pack P2. The second strap is arranged by fixing one end to the first side face SF1' of the second pack P2, passing the strap around edge E1' across the first faces F1 and F1' and around the second edge E2 of the first pack P1 and affixing the strap to the second side face SF2 of the first pack.

By operating the packs about the strap system as illustrated in FIG. 28A, the arrangement of the packs P1 and P2 is changeable from the package having a square cross section, comprised of two triangles, to a package having a triangular cross section (FIG. 28B).

A further example of applying the strap system to triangular shaped packs P1 and P2 is illustrated in FIG. 28C. The two packs are arranged to form a package having a square cross section. In this example, in the first position the first strap S1 is fixed at the second side face SF2 that adjoins the third edge E3 of the first pack P1. The first strap S1 extends across the first side face SF1 of the first pack P1, around the first edge E1 of the first pack P1 and across the first face F1 and F1' of both packs around the second edge E2' of the second pack P2 and is fixed at the second side face SF2' of the second pack P2. The second strap S2 is fixed at the second side face SF2' of the second pack P2 and extends around the third edge E3' of the second pack P2, across the first side face SF1' of the second pack P2, around the first edge E1' of the second pack P2, across the first faces F1, F1' of both the first and second packs and around the second edge E2 of the first pack P1. The end of the second strap S2 is then fixed at the second side face SF2 of the first pack. The arrangement of the straps provides for the first strap S1 being hinged about the first edge E1' of the second pack P2 and the first E1 and third edges E3 of the first pack P1. The second strap S2 is hinged about the second edge E2 of the first pack P1 and the first E1' and third edges E3' of the second pack P2. The first and second packs P1, P2 are movable relative to each other from the first position to the position illustrated in FIG. 28 B, wherein the second pack P2 is rotated relative to the first pack P1 about the second edge E2, or alternatively the packs are able to reach the same position by rotating the first pack P1 relative to the second pack P2 about the first edge E1 and the third edge E3. Soft cup packs Such packs have a base from which upstand faces and edges. The edges tend to be rounded. The faces and edges are not rigid. The Jacobs ladder arrangement may be applied to soft cup packs. Some examples of such packs have a tear tape around or near the top of the pack. The straps of the Jacobs Ladder arrangement are arranged relative to the openings of the packs so that the packs may be opened without damaging or breaking the straps.

Tobacco Pouches

Tobacco pouches are generally formed of two laminated sheets heat-sealed about their periphery with one edge open into which contents are placed.

The strap system as described and illustrated herein, in particular the use of the joining blank JL as illustrated in FIGS. 15C, 23D, 24E, 25C and 26D, could be utilised to combine two or more tobacco pouches.

More than Two Packs

The principle of the invention may be applied to connecting more than two packs. For example three packs may be connected.

The invention claimed is:

1. A package for smoking articles comprising: first and second packs each capable of containing items, each pack having a first face bound by a first edge and a second edge, and a connection between the first and second packs comprising at least first and second straps which extend between the first and second packs; wherein, in a first position of the packs the first face of the first and second packs face each other with the first edges of the first and second pack adjacent to each other and the second edges of the first and second pack adjacent each other, the first face of each pack lying in a plane that joins the first and second edges of each pack respectively and so that the first and second straps extend across the first face of each pack, wherein the first strap is hinged about the first edge of the first pack and hinged about the second edge of the second pack and the second strap is hinged about the second edge of the first pack and hinged about the first edge of the second pack, the first and second packs being movable, one relative to the other between at least the first position, a second position in which the second pack is rotated relative to the first pack about the first edge of the second pack and a third position in which the second pack is rotated relative to the first pack about the second edge of the second pack, said first and second straps in said first position being integral parts of a single member which joins said first and said second straps together, said single member having a first region adjoined by a line of weakness delineating said first strap and having a second region adjoined by said line of weakness delineating said second strap, said first and second straps being separated along said line of weakness upon first movement of said first and second packs relative to each other to either said second or said third position.

2. A package according to claim 1, wherein the first edge and the second edge of each pack are parallel to each other.

3. A package according to claim 1, wherein each pack has a base and the first edge and second edge of each pack each adjoin respectively a first side face and a second side face that co-operate with the first face and the base to form a container that is capable of containing items.

4. A package according to claim 1, wherein the base of each pack is a quadrilateral.

5. A package according to claim 4, wherein the first strap is fixed to the side face that adjoins the first edge of the first pack and is fixed at the side face that adjoins the second edge of the second pack; and the second strap is fixed to the side face that adjoins the first edge of the second pack and is fixed to the side face that adjoins the second edge of the first pack.

6. A package according to claim 1, wherein the first and second straps are separable along a line of weakening in the single member in an area that corresponds with the first faces of the first and second packs.

7. A package according to claim 1, wherein portions of the first and second straps outside the area of the first faces are separate from each other.

8. A package according to claim 1, wherein the single member is paper, plastic or cardboard.

9. A package according to claim 1, wherein the single member is fixed to the first and second packs.

10. A package according to claim 1, wherein the first and second packs contain smoking articles.

11. A package according to claim 1, wherein the single member is separable to provide a first strap and a pair of second strap portions, a second strap portion being located on either side of the first strap.

12. A package according to claim 11, wherein the single member is separable along a first line of weakening between the first strap and one of said second strap portions and along a second line of weakening between the first strap and the other second strap portion.

* * * * *